US010351935B2

(12) United States Patent
Sakuma et al.

(10) Patent No.: US 10,351,935 B2
(45) Date of Patent: Jul. 16, 2019

(54) MAGNETIC COMPOUND AND METHOD OF PRODUCING THE SAME

(71) Applicant: TOYOTA JIDOSHA KABUSHIKI KAISHA, Toyota-shi, Aichi-ken (JP)

(72) Inventors: Noritsugu Sakuma, Mishima (JP); Akira Kato, Mishima (JP); Kota Washio, Sunto-gun (JP); Hidefumi Kishimoto, Susono (JP); Masao Yano, Sunto-gun (JP); Akira Manabe, Miyoshi (JP); Masaaki Ito, Susono (JP); Shunji Suzuki, Iwata (JP); Kurima Kobayashi, Fukuroi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 833 days.

(21) Appl. No.: 14/844,478

(22) Filed: Sep. 3, 2015

(65) Prior Publication Data

US 2016/0071635 A1 Mar. 10, 2016

(30) Foreign Application Priority Data

Sep. 9, 2014 (JP) ..... 2014-183705
May 12, 2015 (JP) ..... 2015-097526

(51) Int. Cl.
*C22C 30/02* (2006.01)
*H01F 1/059* (2006.01)
(Continued)

(52) U.S. Cl.
CPC ..... *C22C 30/02* (2013.01); *C22C 1/02* (2013.01); *C22C 30/00* (2013.01); *C22C 38/00* (2013.01); *H01F 1/0593* (2013.01)

(58) Field of Classification Search
CPC ..... C22C 30/02; C22C 1/02; C22C 30/00; C22C 38/00; H01F 1/0593
(Continued)

(56) References Cited

U.S. PATENT DOCUMENTS 5,456,769 A * 10/1995 Sakurada ..... C22C 38/00 148/301
5,480,495 A * 1/1996 Sakurada ..... H01F 1/055 148/301
(Continued)

FOREIGN PATENT DOCUMENTS

JP H06-235051 A 8/1994
JP H06-283316 A 10/1994
(Continued)

OTHER PUBLICATIONS

Hirayama et al., "NdFe12Nx Hard-Magnetic Compound with High Magnetization and Anisotropy Field," Science Direct, Scripta Materialia, 2015, vol. 95, pp. 70-72.

*Primary Examiner* — Patricia L. Hailey
(74) *Attorney, Agent, or Firm* — Oliff PLC

(57) ABSTRACT

Provided is a magnetic compound represented by the formula $(R_{(1-x)}Zr_x)_a(Fe_{(1-y)}Co_y)_bT_cM_dA_e$ (wherein R represents one or more rare earth elements, T represents one or more elements selected from the group consisting of Ti, V, Mo, and W, M represents one or more elements selected from the group consisting of unavoidable impurity elements, Al, Cr, Cu, Ga, Ag, and Au, A represents one or more elements selected from the group consisting of N, C, H, and P, $0 \le x \le 0.5$, $0 \le y \le 0.6$, $4 \le a \le 20$, $b=100-a-c-d$, $0<c<7$, $0 \le d \le 1$, and $1 \le e \le 18$), in which a main phase of the magnetic compound includes a $ThMn_{12}$ type crystal structure, and a volume percentage of an α-(Fe,Co) phase is 20% or lower.

7 Claims, 26 Drawing Sheets

R ◯ 2a
Fe(T) ◐ 8f ⊙ 8i ◓ 8j
N ● 2b

(51) Int. Cl.
*C22C 1/02* (2006.01)
*C22C 30/00* (2006.01)
*C22C 38/00* (2006.01)

(58) Field of Classification Search
USPC ..... 148/100; 252/62.51 R, 62.55, 61.51 C; 420/10, 104–105, 110, 111
See application file for complete search history.

(56) References Cited

U.S. PATENT DOCUMENTS

| | | | | |
|---|---|---|---|---|
| 2001/0020495 | A1 | 9/2001 | Mei et al. | |
| 2013/0020527 | A1* | 1/2013 | Li | C22C 33/0278 252/62.55 |
| 2018/0062455 | A1* | 3/2018 | Hagiwara | H01F 1/0557 |

FOREIGN PATENT DOCUMENTS

| | | | |
|---|---|---|---|
| JP | 2001-189206 | A | 7/2001 |
| JP | 2004-265907 | A | 9/2004 |
| JP | 2006-183151 | A | 7/2006 |
| JP | 2013-157487 | A | 8/2013 |

* cited by examiner

STABLE REGION OF $RFe_{12-x}T_x$ COMPOUND

FIG. 7

| | Composition | Anisotropy Field (MA/m) | Saturation Magnetization @RT (T) | Saturation Magnetization @180°C (T) | Size of α-(Fe,Co) (μm) | Volume Percentage of α-(Fe,Co) (%) | Hex. (A) (nm) |
|---|---|---|---|---|---|---|---|
| Comparative Example 1 | $Nd_{12}Fe_{83}B_5$ | 6.1 | 1.61 | 1.3 | - | - | - |
| Comparative Example 2 | $Nd_{7.7}Fe_{80.8}Ti_{11.5}N_{7.7}$ | 7.6 | 1.35 | 1.24 | <1 | <3.5 | 0.616 |
| Comparative Example 3 | $Nd_{7.7}Fe_{84.6}Ti_{7.7}N_{7.7}$ | 7.4 | 1.38 | 1.27 | <1 | <3.5 | 0.611 |
| Comparative Example 4 | $Nd_{7.7}(Fe_{0.75}Co_{0.25})_{84.6}Ti_{7.7}N_{7.7}$ | 7.9 | 1.47 | 1.40 | <1 | <3.5 | 0.611 |
| Comparative Example 5 | $(Nd_{0.7}Zr_{0.3})_{7.7}(Fe_{0.75}Co_{0.25})_{84.6}Ti_{7.7}N_{7.7}$ | 6.5 | 1.52 | 1.44 | <1 | <3.5 | 0.598 |
| Example 1 | $(Nd_{0.7}Zr_{0.3})_{7.7}(Fe_{0.75}Co_{0.25})_{88.5}Ti_{3.8}N_{7.7}$ | 6.9 | 1.68 | 1.60 | 1.1 | 3.9 | 0.593 |
| Example 2 | $(Nd_{0.7}Zr_{0.3})_{7.7}Fe_{88.5}Ti_{3.8}N_{7.7}$ | 6.6 | 1.62 | 1.49 | 1.2 | 4.2 | 0.593 |
| Example 3 | $Nd_{7.7}(Fe_{0.75}Co_{0.25})_{88.5}Ti_{3.8}N_{7.7}$ | 7.6 | 1.69 | 1.61 | <1 | <3.5 | 0.606 |
| Example 4 | $(Nd_{0.86}Pr_{0.14})_{7.7}(Fe_{0.75}Co_{0.25})_{88.5}Ti_{3.8}N_{7.7}$ | 7.9 | 1.65 | 1.57 | 1.1 | 3.9 | 0.606 |
| Example 5 | $Nd_{8.6}(Fe_{0.75}Co_{0.25})_{87.6}Ti_{3.8}N_{7.7}$ | 7.9 | 1.63 | 1.55 | 1.2 | 4.2 | 0.606 |

FIG. 12

| | Composition | Melting Method Cooling Rate | Homogenization Heat Treatment | Size of α-(Fe,Co) (μm) | Volume Percentage of α-(Fe,Co) (%) | Anisotropy Field (MA/m) | Saturation Magnetization @RT (T) | Saturation Magnetization @180°C (T) | Hex. (A) (nm) |
|---|---|---|---|---|---|---|---|---|---|
| Comparative Example 6 | $Nd_{7.7}(Fe_{0.75}Co_{0.25})_{84.6}Ti_{7.7}N_{7.7}$ | Arc Melting 50 K/s | None | 7 | 16.2 | 4.9 | 1.5 | 1.43 | 0.611 |
| Comparative Example 7 | $Nd_{7.7}(Fe_{0.75}Co_{0.25})_{84.6}Ti_{7.7}N_{7.7}$ | Arc Melting 50 K/s | 1100°C 4 Hours | 5 | 13.5 | 5.3 | 1.48 | 1.41 | 0.611 |
| Comparative Example 8 | $Nd_{7.7}(Fe_{0.75}Co_{0.25})_{88.5}Ti_{3.8}N_{7.7}$ | Arc Melting 50 K/s | 1100°C 4 Hours | 8.9 | 17.5 | 3.9 | 1.7 | 1.62 | 0.606 |
| Comparative Example 9 | $(Nd_{0.7}Zr_{0.3})_{7.7}(Fe_{0.75}Co_{0.25})_{84.6}Ti_{7.7}N_{7.7}$ | Arc Melting 50 K/s | None | 3 | 8.3 | 5.5 | 1.47 | 1.40 | 0.598 |
| Comparative Example 10 | $(Nd_{0.7}Zr_{0.3})_{7.7}(Fe_{0.75}Co_{0.25})_{84.6}Ti_{7.7}N_{7.7}$ | Arc Melting 50 K/s | 1100°C 4 Hours | 2.5 | 4.5 | 5.8 | 1.46 | 1.39 | 0.598 |
| Example 6 | $Nd_{7.7}(Fe_{0.75}Co_{0.25})_{88.5}Ti_{3.8}N_{7.7}$ | Quenching $10^4$ K/s | None | 1.8 | 6 | 6.3 | 1.69 | 1.61 | 0.606 |
| Example 7 | $Nd_{7.7}(Fe_{0.75}Co_{0.25})_{88.5}Ti_{3.8}N_{7.7}$ | Quenching $10^4$ K/s | 1200°C 4 Hours | 1.1 | 3.9 | 6.9 | 1.68 | 1.60 | 0.606 |
| Comparative Example 11 | $(Nd_{0.7}Zr_{0.3})_{7.7}(Fe_{0.75}Co_{0.25})_{84.6}Ti_{7.7}N_{7.7}$ | Quenching $10^4$ K/s | None | <1 | <3.5 | 6.4 | 1.51 | 1.44 | 0.598 |
| Comparative Example 12 | $(Nd_{0.7}Zr_{0.3})_{7.7}(Fe_{0.75}Co_{0.25})_{84.6}Ti_{7.7}N_{7.7}$ | Quenching $10^4$ K/s | 1100°C 4 Hours | <1 | <3.5 | 6.5 | 1.52 | 1.44 | 0.598 |

FIG. 16

| | Composition | Co Substitution Ratio | Size of α-(Fe,Co) (μm) | Volume Percentage of α-(Fe,Co) (%) | Anisotropy Field (MA/m) | Saturation Magnetization @RT (T) | Saturation Magnetization @180°C (T) | Curie Point (°C) | Hex. (A) (nm) |
|---|---|---|---|---|---|---|---|---|---|
| Example 8 | $Nd_{7.7}Fe_{86.1}Ti_{6.2}N_{7.7}$ | 0 | <1 | <3.5 | 6.2 | 1.49 | 1.37 | 480 | 0.609 |
| Example 9 | $Nd_{7.7}(Fe_{0.9}Co_{0.1})_{86.1}Ti_{6.2}N_{7.7}$ | 0.1 | <1 | <3.5 | 6.3 | 1.54 | 1.44 | 560 | 0.609 |
| Example 10 | $Nd_{7.7}(Fe_{0.8}Co_{0.2})_{86.1}Ti_{6.2}N_{7.7}$ | 0.2 | <1 | <3.5 | 6.7 | 1.59 | 1.51 | 620 | 0.609 |
| Example 11 | $Nd_{7.7}(Fe_{0.7}Co_{0.3})_{86.1}Ti_{6.2}N_{7.7}$ | 0.3 | <1 | <3.5 | 6.9 | 1.61 | 1.58 | 700 | 0.609 |
| Example 12 | $Nd_{7.7}(Fe_{0.6}Co_{0.4})_{86.1}Ti_{6.2}N_{7.7}$ | 0.4 | <1 | <3.5 | 6.8 | 1.59 | 1.57 | 720 | 0.608 |
| Example 13 | $Nd_{7.7}(Fe_{0.5}Co_{0.5})_{86.1}Ti_{6.2}N_{7.7}$ | 0.5 | <1 | <3.5 | 6.7 | 1.57 | 1.55 | - | 0.608 |
| Example 14 | $Nd_{7.7}(Fe_{0.4}Co_{0.6})_{86.1}Ti_{6.2}N_{7.7}$ | 0.6 | <1 | <3.5 | 6.5 | 1.5 | 1.48 | - | 0.608 |
| Example 15 | $Nd_{7.7}(Fe_{0.3}Co_{0.7})_{86.1}Ti_{6.2}N_{7.7}$ | 0.7 | <1 | <3.5 | 6.5 | 1.45 | 1.44 | - | 0.608 |
| Comparative Example 13 | $Nd_{7.7}Co_{86.1}Ti_{6.2}N_{7.7}$ | 1 | <1 | <3.5 | 6.4 | 1.2 | 1.19 | - | 0.607 |

FIG. 25

| | Composition | Ti Content (at%) | Formed Phase | Size of α-(Fe,Co) (μm) | Volume Percentage of α-(Fe,Co) (%) | Anisotropy Field (MA/m) | Saturation Magnetization @RT (T) | Saturation Magnetization @180°C (T) | Hex. (A) (nm) |
|---|---|---|---|---|---|---|---|---|---|
| Comparative Example 14 | $Nd_{7.7}(Fe_{0.75}Co_{0.25})_{92.3}N_{4.9}$ | 0 | 2-17 Phase | - | - | - | - | - | - |
| Comparative Example 15 | $Nd_{7.7}(Fe_{0.75}Co_{0.25})_{90.4}Ti_{1.9}N_{4.9}$ | 1.9 | 2-17 Phase | - | - | - | - | - | - |
| Comparative Example 16 | $Nd_{7.7}(Fe_{0.75}Co_{0.25})_{88.5}Ti_{3.8}N_{6.9}$ | 3.8 | 3-29 Phase | - | - | - | - | - | - |
| Example 16 | $Nd_{7.7}(Fe_{0.75}Co_{0.25})_{86.5}Ti_{5.8}N_{10.8}$ | 5.8 | 1-12 Phase | <1 | <3.5 | 7.7 | 1.58 | 1.50 | 0.608 |
| Comparative Example 17 | $Nd_{7.7}(Fe_{0.75}Co_{0.25})_{84.6}Ti_{7.7}N_{10.8}$ | 7.7 | 1-12 Phase | <1 | <3.5 | 7.9 | 1.47 | 1.40 | 0.611 |

FIG. 26

| | Ti Content (at%) | a (nm) | c (nm) | V ($nm^3$) | Hex. (A) |
|---|---|---|---|---|---|
| Comparative Example 14 | 0 | | | - | - |
| Comparative Example 15 | 1.9 | | | - | - |
| Comparative Example 16 | 3.8 | | | - | - |
| Example 16 | 5.8 | 0.871 | 0.482 | 0.366 | 0.608 |
| Comparative Example 17 | 7.7 | 0.869 | 0.482 | 0.363 | 0.611 |

FIG. 28

| | Composition | x: Zr Substitution Ratio | c: Ti Content (at%) | Formed Phase | Size of α-(Fe,Co) (μm) | Volume Percentage of α-(Fe,Co) (%) | Anisotropy Field (MA/m) | Saturation Magnetization @RT (T) | Saturation Magnetization @180°C (T) | Hex. (A) (nm) |
|---|---|---|---|---|---|---|---|---|---|---|
| Comparative Example 18 | $Nd_{7.7}(Fe_{0.75}Co_{0.25})_{92.3}N_{7.7}$ | 0 | 0 | 2-17 Phase | - | - | - | - | - | - |
| Comparative Example 19 | $(Nd_{0.9}Zr_{0.1})_{7.7}(Fe_{0.75}Co_{0.25})_{92.3}N_{7.7}$ | 0.1 | 0 | 1-12 Phase +α-Fe>20% | 1.5 | >20 | - | - | - | - |
| Comparative Example 20 | $(Nd_{0.7}Zr_{0.3})_{7.7}(Fe_{0.75}Co_{0.25})_{92.3}N_{7.7}$ | 0.3 | 0 | 1-12 Phase +α-Fe>20% | 1.5 | >20 | - | - | - | - |
| Comparative Example 21 | $(Nd_{0.5}Zr_{0.5})_{7.7}(Fe_{0.75}Co_{0.25})_{92.3}N_{7.7}$ | 0.5 | 0 | 3-29 Phase | - | - | - | - | - | - |
| Comparative Example 22 | $Nd_{7.7}(Fe_{0.75}Co_{0.25})_{90.4}Ti_{1.9}N_{7.7}$ | 0 | 1.9 | 2-17 Phase | - | - | - | - | - | - |
| Example 17 | $(Nd_{0.9}Zr_{0.1})_{7.7}(Fe_{0.75}Co_{0.25})_{90.4}Ti_{1.9}N_{7.7}$ | 0.1 | 1.9 | 1-12 Phase | 1.3 | 11.2 | 6.1 | 1.72 | 1.63 | 0.599 |
| Comparative Example 23 | $(Nd_{0.7}Zr_{0.3})_{7.7}(Fe_{0.75}Co_{0.25})_{90.4}Ti_{1.9}N_{7.7}$ | 0.3 | 1.9 | 1-12 Phase +α-Fe>20% | 1.5 | >20 | - | - | - | - |
| Comparative Example 24 | $Nd_{7.7}(Fe_{0.75}Co_{0.25})_{88.5}Ti_{3.8}N_{7.7}$ | 0 | 3.8 | 3-29 Phase | - | - | - | - | - | 0.606 |
| Example 18 | $(Nd_{0.9}Zr_{0.1})_{7.7}(Fe_{0.75}Co_{0.25})_{88.5}Ti_{3.8}N_{7.7}$ | 0.1 | 3.8 | 1-12 Phase | 1.3 | 7.1 | 6.4 | 1.69 | 1.61 | 0.601 |
| Example 19 | $(Nd_{0.8}Zr_{0.2})_{7.7}(Fe_{0.75}Co_{0.25})_{88.5}Ti_{3.8}N_{7.7}$ | 0.2 | 3.8 | 1-12 Phase | 1.1 | 4 | 6.7 | 1.68 | 1.60 | 0.597 |
| Example 20 | $(Nd_{0.7}Zr_{0.3})_{7.7}(Fe_{0.75}Co_{0.25})_{88.5}Ti_{3.8}N_{7.7}$ | 0.3 | 3.8 | 1-12 Phase | 1.1 | 3.9 | 6.9 | 1.68 | 1.60 | 0.593 |
| Example 21 | $(Nd_{0.6}Zr_{0.4})_{7.7}(Fe_{0.75}Co_{0.25})_{88.5}Ti_{3.8}N_{7.7}$ | 0.4 | 3.8 | 1-12 Phase | 1.2 | 6.1 | 6.4 | 1.67 | 1.59 | 0.588 |
| Comparative Example 25 | $(Nd_{0.5}Zr_{0.5})_{7.7}(Fe_{0.75}Co_{0.25})_{88.5}Ti_{3.8}N_{7.7}$ | 0.5 | 3.8 | 3-29 Phase | - | - | - | - | - | - |
| Example 22 | $Nd_{7.7}(Fe_{0.75}Co_{0.25})_{88.5}Ti_{5.8}N_{7.7}$ | 0 | 5.8 | 1-12 Phase | <1 | <3.5 | 7.7 | 1.58 | 1.50 | 0.608 |
| Example 23 | $(Nd_{0.9}Zr_{0.1})_{7.7}(Fe_{0.75}Co_{0.25})_{86.5}Ti_{5.8}N_{7.7}$ | 1 | 5.8 | 1-12 Phase | <1 | <3.5 | 7.7 | 1.57 | 1.49 | 0.604 |

FIG. 29

| | Composition | x: Zr Substitution Ratio | c: Ti Content (at%) | Formed Phase | Size of α-(Fe,Co) (μm) | Volume Percentage of α-(Fe,Co) (%) | Anisotropy Field (MA/m) | Saturation Magnetization @RT (T) | Saturation Magnetization @180°C (T) | Hex. (A) (nm) |
|---|---|---|---|---|---|---|---|---|---|---|
| Example 24 | $(Nd_{0.8}Zr_{0.2})_{7.7}(Fe_{0.75}Co_{0.25})_{86.5}Ti_{5.8}N_{7.7}$ | 0.2 | 5.8 | 1-12 Phase | <1 | <3.5 | 7.6 | 1.56 | 1.48 | 0.600 |
| Example 25 | $(Nd_{0.7}Zr_{0.3})_{7.7}(Fe_{0.75}Co_{0.25})_{86.5}Ti_{5.8}N_{7.7}$ | 0.3 | 5.8 | 1-12 Phase | <1 | <3.5 | 7.8 | 1.57 | 1.49 | 0.595 |
| Example 26 | $(Nd_{0.6}Zr_{0.4})_{7.7}(Fe_{0.75}Co_{0.25})_{86.5}Ti_{5.8}N_{7.7}$ | 0.4 | 5.8 | 1-12 Phase | <1 | <3.5 | 7.3 | 1.56 | 1.48 | 0.591 |
| Example 27 | $(Nd_{0.5}Zr_{0.5})_{7.7}(Fe_{0.75}Co_{0.25})_{86.5}Ti_{5.8}N_{7.7}$ | 0.5 | 5.8 | 1-12 Phase | <1 | <3.5 | 7.1 | 1.55 | 1.47 | 0.587 |
| Comparative Example 26 | $Nd_{7.7}(Fe_{0.75}Co_{0.25})_{84.6}Ti_{7.7}N_{7.7}$ | 0 | 7.7 | 1-12 Phase | <1 | <3.5 | 7.9 | 1.47 | 1.40 | 0.611 |
| Comparative Example 27 | $(Nd_{0.9}Zr_{0.1})_{7.7}(Fe_{0.75}Co_{0.25})_{84.6}Ti_{7.7}N_{7.7}$ | 0.1 | 7.7 | 1-12 Phase | <1 | <3.5 | 7.1 | 1.48 | 1.41 | 0.606 |
| Comparative Example 28 | $(Nd_{0.8}Zr_{0.2})_{7.7}(Fe_{0.75}Co_{0.25})_{84.6}Ti_{7.7}N_{7.7}$ | 0.2 | 7.7 | 1-12 Phase | <1 | <3.5 | 6.4 | 1.49 | 1.42 | 0.602 |
| Comparative Example 29 | $(Nd_{0.7}Zr_{0.3})_{7.7}(Fe_{0.75}Co_{0.25})_{84.6}Ti_{7.7}N_{7.7}$ | 0.3 | 7.7 | 1-12 Phase | <1 | <3.5 | 6.5 | 1.52 | 1.44 | 0.598 |
| Comparative Example 30 | $(Nd_{0.6}Zr_{0.4})_{7.7}(Fe_{0.75}Co_{0.25})_{84.6}Ti_{7.7}N_{7.7}$ | 0.4 | 7.7 | 1-12 Phase | <1 | <3.5 | 6.4 | 1.51 | 1.44 | 0.593 |
| Comparative Example 31 | $(Nd_{0.5}Zr_{0.5})_{7.7}(Fe_{0.75}Co_{0.25})_{84.6}Ti_{7.7}N_{7.7}$ | 0.5 | 7.7 | 1-12 Phase | <1 | <3.5 | 6.3 | 1.49 | 1.42 | 0.589 |

FIG. 31

| | Composition | N Content (at%) | Size of α-(Fe,Co) (μm) | Volume Percentage of α-(Fe,Co) (%) | Anisotropy Field (MA/m) | Saturation Magnetization @RT (T) | Saturation Magnetization @180°C (T) | a (nm) | c (nm) | V ($nm^3$) | Hex. (A) (nm) |
|---|---|---|---|---|---|---|---|---|---|---|---|
| Comparative Example 32 | $Nd_{7.7}(Fe_{0.75}Co_{0.25})_{86.5}Ti_{5.8}N_e$ | 0.0 | <1 | <3.5 | 5.8 | 1.49 | 1.42 | 0.857 | 0.478 | 0.351 | 0.608 |
| Example 28 | $Nd_{7.7}(Fe_{0.75}Co_{0.25})_{86.5}Ti_{5.8}N_e$ | 2.5 | <1 | <3.5 | 6.8 | 1.54 | 1.46 | 0.868 | 0.487 | 0.366 | 0.608 |
| Example 29 | $Nd_{7.7}(Fe_{0.75}Co_{0.25})_{86.5}Ti_{5.8}N_e$ | 9.2 | <1 | <3.5 | 7.8 | 1.63 | 1.55 | 0.871 | 0.482 | 0.366 | 0.608 |
| Comparative Example 33 | $Nd_{7.7}Fe_{86.5}Ti_{5.8}N_e$ | 0.0 | <1 | <3.5 | 5.4 | 1.50 | 1.43 | 0.860 | 0.480 | 0.355 | 0.608 |
| Example 30 | $Nd_{7.7}Fe_{86.5}Ti_{5.8}N_e$ | 7.7 | <1 | <3.5 | 7.3 | 1.62 | 1.54 | 0.868 | 0.491 | 0.370 | 0.608 |
| Example 31 | $Nd_{7.7}Fe_{86.5}Ti_{5.8}N_e$ | 11.5 | <1 | <3.5 | 7.4 | 1.62 | 1.54 | 0.869 | 0.496 | 0.375 | 0.608 |
| Example 32 | $Nd_{7.7}Fe_{86.5}Ti_{5.8}N_e$ | 14.6 | <1 | <3.5 | 7.4 | 1.61 | 1.53 | 0.868 | 0.499 | 0.376 | 0.608 |
| Example 33 | $Nd_{7.7}Fe_{86.5}Ti_{5.8}N_e$ | 15.4 | <1 | <3.5 | 7.5 | 1.60 | 1.52 | 0.867 | 0.503 | 0.378 | 0.608 |

MAGNETIC COMPOUND AND METHOD OF PRODUCING THE SAME

INCORPORATION BY REFERENCE

The disclosure of Japanese Patent Application No. 2014-183705 and 2015-097526 filed on Sep. 9, 2014 and May 12, 2015 including the specification, drawings and abstract is incorporated herein by reference in its entirety.

BACKGROUND OF THE INVENTION

1. Field of the Invention

The present invention relates to a magnetic compound having a $ThMn_{12}$ type crystal structure with high anisotropy field and high saturation magnetization, and a method of producing the same.

2. Description of Related Art

The application of a permanent magnet has been spread in a wide range of fields including electronics, information and telecommunications, medical cares, machine tools, and industrial and automotive motors, and the demand for reduction in the amount of carbon dioxide emissions has increased. In such a situation, development of a high-performance permanent magnet has been increasingly expected along with the spread of hybrid vehicles, energy-saving in industrial fields, the improvement of power generation efficiency, and the like.

A Nd—Fe—B magnet which is currently predominant in the market as a high-performance magnet is used as a magnet for a drive motor of a HV/EHV. Recently, it has been required to further reduce the size of a motor and to further increase the output of a motor (to increase the residual magnetization of a magnet). Accordingly, the development of a new permanent magnet material has been progressing.

In order to develop a material having higher performance than a Nd—Fe—B magnet, a study regarding a rare earth element-iron magnetic compound having a $ThMn_{12}$ type crystal structure has been carried out. For example, Japanese Patent Application Publication No. 2004-265907 (JP 2004-265907 A) proposes a hard magnetic composition which is represented by $R(Fe_{100-y-w}Co_wTi_y)_xSi_zA_v$ (wherein R represents one element or two or more elements selected from rare earth elements including Y in which Nd accounts for 50 mol % or higher of the total amount of R; A represents one element or two elements of N and C; x=10 to 12.5; y=(8.3-1.7×z) to 12; z=0.2 to 2.3; v=0.1 to 3; and w=0 to 30) and has a single-layer structure of a phase having a $ThMn_{12}$ type crystal structure.

In the currently proposed compound which has a $NdFe_{11}TiN_x$ composition having a $ThMn_{12}$ type crystal structure, anisotropy field is high; however, saturation magnetization is lower than that of a Nd—Fe—B magnet and does not reach the level of a magnet material.

SUMMARY OF THE INVENTION

The invention provides a magnetic compound having high anisotropy field and high saturation magnetization at the same time.

According to the first aspect of the invention, the following configuration is provided. A magnetic compound represented by the formula $(R_{(1-x)}Zr_x)_a(Fe_{(1-y)}Co_y)_bT_cM_dA_e$ (wherein R represents one or more rare earth elements, T represents one or more elements selected from the group consisting of Ti, V, Mo, and W, M represents one or more elements selected from the group consisting of unavoidable impurity elements, Al, Cr, Cu, Ga, Ag, and Au, A represents one or more elements selected from the group consisting of N, C, H, and P, $0 \le x \le 0.5$, $0 \le y \le \le 0.6$, $4 \le a \le 20$, b=100−a−c−d, $0<c<7$, $0 \le d \le 1$, and $1 \le e \le 18$), the magnetic compound including a $ThMn_{12}$ type crystal structure, in which a volume percentage of an α-(Fe,Co) phase is 20% or lower.

In the magnetic compound, $0 \le x \le 0.3$, and $7 \le e \le 14$ may be satisfied.

In the magnetic compound, in the formula, a relationship between x and c may satisfy a region surrounded by $0<c<7$, $x \ge 0$, $c>-38x+3.8$ and $c>6.3x+0.65$.

A method of producing the above-described magnetic compound of the second aspect of the present invention, the method including: a step of preparing molten alloy having a composition represented by the formula $(R_{(1-x)}Zr_x)_a(Fe_{(1-y)}Co_y)_bT_cM_d$ (wherein R represents one or more rare earth elements, T represents one or more elements selected from the group consisting of Ti, V, Mo, and W, M represents one or more elements selected from the group consisting of unavoidable impurity elements, Al, Cr, Cu, Ga, Ag, and Au, $0 \le x \le 0.5$, $0 \le y \le 0.6$, $4 \le a \le 20$, b=100−a−c−d, $0<c<7$, and $0 \le d \le 1$); a step of quenching the molten alloy at a rate of $1\times10^2$ K/sec to $1\times10^7$ K/sec; and a step of crushing solidified alloy, which is obtained by the quenching, and then causing A (A represents one or more elements selected from the group consisting of N, C, H, and P) to penetrate into the crushed alloy.

The method may include a step of performing a heat treatment at 800° C. to 1300° C. for 2 hours to 120 hours after the quenching step.

A rare earth element-containing magnetic compound of the third aspect of the invention including a $ThMn_{12}$ type crystal structure, in which a lattice constant a of the crystal structure is within a range of 0.850 nm to 0.875 nm, a lattice constant c of the crystal structure is within a range of 0.480 nm to 0.505 nm, a lattice volume of the crystal structure is within a range of 0.351 $nm^3$ to 0.387 $nm^3$, a hexagon A is defined as a six-membered ring centering on a rare earth atom, which is formed of Fe (8i) and Fe(8j) sites, a hexagon B is defined as a six-membered ring which includes Fe (8i) and Fe(8j) sites in which Fe (8i)-Fe (8i) dumbbells form two sides facing each other, a hexagon C is defined as a six-membered ring which is formed of Fe (8j) and Fe(8f) sites and whose center is positioned on a straight line connecting Fe (8i) and a rare earth atom to each other, a length of the hexagon A in a direction of axis a is shorter than 0.611 nm, an average distance between Fe (8i) and Fe (8i) in the hexagon A is 0.254 nm to 0.288 nm, an average distance between Fe (8j) and Fe (8j) in the hexagon B is 0.242 nm to 0.276 nm, and an average distance between Fe (8f) and Fe (8f) facing each other with the center of the hexagon C interposed therebetween in the hexagon C is 0.234 nm to 0.268 nm.

A magnetic powder of the fourth aspect of the present invention which is made of a compound represented by the formula $(R_{(1-x)}Zr_x)_a(Fe_{(1-y)}Co_y)_bT_cM_dA_e$ (wherein R represents one or more rare earth elements, T represents one or more elements selected from the group consisting of Ti, V, Mo, and W, M represents one or more elements selected from the group consisting of unavoidable impurity elements, Al, Cr, Cu, Ga, Ag, and Au, A represents one or more elements selected from the group consisting of N, C, H, and P, $0 \le x \le 0.5$, $0 \le y \le 0.7$, $4 \le a \le 20$, b=100−a−c−d, $0<c \le 7$, $0 \le d \le 1$, and $1 \le e \le 18$), the magnetic powder including a $ThMn_{12}$ type crystal structure, in which a volume percentage of an α-(Fe, Co) phase is 20% or lower.

According to the invention, in the compound which includes a $ThMn_{12}$ type crystal structure and is represented by the formula $(R_{(1-x)}Zr_x)_a(Fe_{(1-y)}Co_y)_bT_cM_dA_e$, percentages of magnetic elements including Fe and Co can increase and magnetization can be improved by reducing the T content. In addition, the amount of an α-(Fe,Co) phase deposited during cooling can be reduced by adjusting the cooling rate of molten alloy during the production process, and magnetization can be improved by depositing a large amount of a $ThMn_{12}$ type crystal. Further, a balance between the sizes of the respective hexagons can be improved and a $ThMn_{12}$ type crystal structure can be stably obtained by adjusting the sizes of the respective hexagons as defined above in (6).

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 7 is a table showing the compositions and characteristics of magnets of Examples 1 to 5 and Comparative Examples 1 to 5;

FIG. 12 is a table showing the compositions, production methods, and characteristics of magnets of Examples 6 and 7 and Comparative Examples 6 to 12;

FIG. 16 is a table showing the compositions, Co substitution ratios, and characteristics of magnets of Examples 8 to 15 and Comparative Example 13;

FIG. 25 is a table showing the compositions and characteristics of magnets of Example 16 and Comparative Examples 14 to 17;

FIG. 26 is a table showing the Ti contents of magnets of Example 16 and Comparative Examples 14 to 17;

FIG. 28 is a table showing the compositions and characteristics of magnets of Examples 17 to 23 and Comparative Examples 18 to 25;

FIG. 29 is a table showing the compositions and characteristics of magnets of Examples 24 to 27 and Comparative Examples 26 to 31;

FIG. 31 is a table showing the compositions and characteristics of magnets of Examples 28 to 33 and Comparative Examples 32 and 33;

DETAILED DESCRIPTION OF EMBODIMENTS

Hereinafter, a magnetic compound according to an embodiment of the invention will be described in detail. The magnetic compound according to the embodiment of the invention is represented by the following formula $(R_{(1-x)}Zr_x)_a(Fe_{(1-y)}Co_y)_bT_cM_dA_e$, and each component thereof will be described below.

R represents a rare earth element and is an essential component in the magnetic compound according to the embodiment of the invention to exhibit permanent magnet characteristics. Specifically, R represents one or more elements selected from Y, La, Ce, Pr, Nd, Sm, and Eu, and Pr, Nd, and Sm are preferably used. A mixing amount a of R is 4 at % or higher and 20 at % or lower. When the mixing amount a of R is lower than 4 at %, the deposition of a Fe phase is great, and the volume percentage of the Fe phase after a heat treatment cannot be decreased. When the mixing amount a of R is higher than 20 at %, the amount of a grain boundary phase is excessively large, and thus magnetization cannot be improved.

Zr is efficient in stabilizing a $ThMn_{12}$ type crystal phase when substituted with a part of rare earth elements. That is, Zr is substituted with R in the $ThMn_{12}$ type crystal structure to cause shrinkage of a crystal lattice. As a result, when the temperature of an alloy becomes high or when a nitrogen atom or the like is caused to penetrate into a crystal lattice, Zr has an effect of stably maintaining the $ThMn_{12}$ type crystal phase. On the other hand, strong magnetic anisotropy derived from R is weakened by Zr substitution from the viewpoint of magnetic characteristics. Therefore, it is necessary to determine the Zr content from the viewpoints of the stability and magnetic characteristics of the crystal. However, in the embodiment of the invention, Zr addition is not essential. When the Zr content is 0, the $ThMn_{12}$ type crystal phase can be stabilized, for example, by adjusting the component composition of an alloy and performing a heat treatment. Therefore, anisotropy field is improved. However, when the amount of Zr substitution is more than 0.5, anisotropy field significantly decreases. It is preferable that the Zr content x satisfies $0 \leq x \leq 0.3$.

Figure 1:
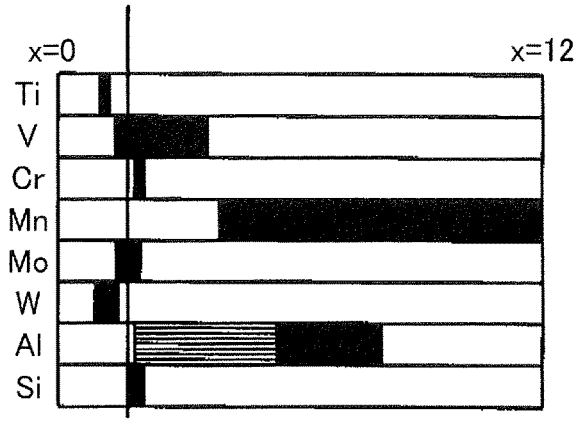
FIG. 1 is a graph showing a stable region of T in an $RFe_{12-x}T_x$ compound.

T represents one or more elements selected from the group consisting of Ti, V, Mo, and W. FIG. 1 is a graph showing a stable region of T in an $RFe_{12-x}T_x$ compound (source: K. H. J. Buschow, Rep. Prog. Phys. 54, 1123 (1991)). It is known that the $ThMn_{12}$ type crystal structure is stabilized and superior magnetic characteristics are exhibited by adding a third element such as Ti, V, Mo, or W to an R—Fe binary alloy.

In the related art, the $ThMn_{12}$ type crystal structure is formed by adding a large amount of T exceeding the necessary amount to obtain the stabilization effect of T. Therefore, the content ratio of Fe constituting the compound in the alloy decreases, and Fe atoms occupying sites, which have the largest effect on magnetization, are replaced with, for example, Ti atoms, thereby decreasing overall magnetization. In order to improve magnetization, the mixing amount of Ti may be decreased. In this case, however, the stabilization of the $ThMn_{12}$ type crystal structure deteriorates. In the related art, $RFe_{11}Ti$ is reported as the $RFe_{12-x}Ti_x$ compound, but a compound in which x is lower than 1, that is, Ti is lower than 7 at % has not been reported.

When the amount of Ti which stabilizes the $ThMm_2$ type crystal structure is reduced, the stabilization of the $ThMn_{12}$ type crystal structure deteriorates, and α-(Fe,Co) which inhibits anisotropy field or coercive force is deposited. According to the embodiment of the invention, the amount of α-(Fe,Co) deposited can be suppressed by controlling the cooling rate of molten alloy; and even when the mixing amount of T decreases, the $ThMn_{12}$ phase having high magnetic characteristics can be stably formed by adjusting the volume percentage of an α-(Fe,Co) phase in the compound to be a certain value or lower.

The mixing amount of T is lower than 7 at % in which x in the $RFe_{12-x}Ti_x$ compound is lower than 1. When the mixing amount of Ti is 7 at % or higher, the content ratio of Fe constituting the compound decreases, and overall magnetization decreases.

In the compound according to the embodiment of the invention represented by the formula $(R_{(1-x)}Zr_x)_a(Fe_{(1-y)}Co_y)_bT_cM_dA_e$, it is preferable that a relationship between the Zr content x and the T content c satisfies a region ($0<c<7$, $x \geq 0$) surrounded by $c>-38x+3.8$ and $c>6.3x+0.65$.

M represents one or more elements selected from the group consisting of unavoidable impurity elements, Al, Cr, Cu, Ga, Ag, and Au. The unavoidable impurity elements refer to elements incorporated into raw materials or elements incorporated during the production process, and specific examples thereof include Si and Mn. M contributes to the inhibition of grain growth of the $ThMn_{12}$ type crystal and the viscosity and melting point of a phase (for example, a grain boundary phase) other than the $ThMn_{12}$ type crystal but is not essential in the invention. A mixing amount d of M is lower than 1 at %. When the mixing amount d of M is higher than 1 at %, the content ratio of Fe constituting the compound in the alloy decreases, and overall magnetization decreases.

A represents one or more elements selected from the group consisting of N, C, H, and P. A can be caused to penetrate into a crystal lattice of the $ThMn_{12}$ phase to expand the lattice in the $ThMn_{12}$ phase such that both characteristics of anisotropy field and saturation magnetization can be improved. A mixing amount e of A is 1 at % or higher and 18 at % or lower. When the mixing amount e of A is lower than 1 at %, the effects cannot be exhibited. When the mixing amount e of A is higher than 18 at %, the content ratio of Fe constituting the compound in the alloy decreases, a part of the $ThMn_{12}$ phase is decomposed due to deterioration in the stability of the ThMn12 phase, and overall magnetization decreases. The mixing amount e of A is preferably $7 \leq e \leq 14$.

A remainder of the compound according to the embodiment of the invention other than the above-described elements is Fe, and a part of Fe may be substituted with Co. Co can be substituted with Fe to cause an increase in spontaneous magnetization according to the Slater-Pauling rule such that both characteristics of anisotropy field and saturation magnetization can be improved. However, when the amount of Co substitution is higher than 0.6, the effects cannot be exhibited. In addition, when Fe is substituted with Co, the Curie point of the compound increases, and thus an effect of suppressing a decrease in magnetization at a high temperature can be obtained.

The magnetic compound according to the embodiment of the invention is represented by the above-described formula and has a $ThMn_{12}$ type crystal structure. This $ThMn_{12}$ type crystal structure is tetragonal and shows peaks at 2θ values of 29.801°, 36.554°, 42.082°, 42.368°, and 43.219° (±0.5°) in the XRD measurement results. Further, in the magnetic compound according to the embodiment of the invention, a volume percentage of an α-(Fe,Co) phase is 20% or lower. This volume percentage is calculated by embedding a sample with a resin, polishing the sample, observing the sample with OM or SEM-EDX, and obtaining an area ratio of the α-(Fe,Co) phase in a cross-section by image analysis. Here, when it is assumed that the structure is not randomly oriented, the following relational expression of $A \cong V$ is established between the average area ratio A and the volume percentage V. Therefore, in the embodiment of the invention, the area ratio of the α-(Fe,Co) phase measured as described above is set as the volume percentage.

As described above, in the magnetic compound according to the embodiment of the invention, magnetization can be improved by reducing the T content as compared to a $RFe_{11}Ti$ type compound of the related art. In addition, both characteristics of anisotropy field and saturation magnetization can be significantly improved by reducing the volume percentage of the α-(Fe,Co) phase.

(Production Method)

Basically, the magnetic compound according to the embodiment of the invention can be produced using a production method of the related art such as a mold casting method or an arc melting method. However, in the method of the related art, a large amount of the stable phase (α-(Fe,Co) phase) other than the $ThMn_{12}$ is deposited, and anisotropy field and saturation magnetization decrease. Here, focusing on the fact that a temperature at which the $ThMn_{12}$ type crystal is deposited is lower than a temperature at which α-(Fe,Co) is deposited, in the embodiment of the invention, molten alloy is quenched at a rate of $1\times10^2$ K/sec to $1\times10^7$ K/sec such that the temperature of the molten alloy is prevented from being maintained in a region near the temperature at which α-(Fe,Co) is deposited for a long period of time. As a result, the deposition of α-(Fe,Co) can be reduced and a large amount of the $ThMn_{12}$ type crystal can be produced.

Figure 2:
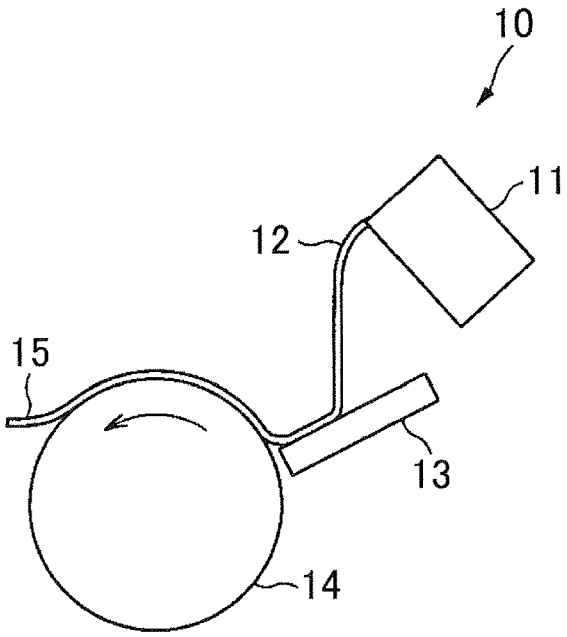
FIG. 2 is a schematic diagram showing an apparatus used in a strip casting method.

As a cooling method, for example, molten alloy can be cooled at a predetermined rate using an apparatus 10 shown in FIG. 2 and a strip casting method. In the apparatus 10, alloy raw materials are melted in a melting furnace 11 to prepare molten alloy 12 having a composition represented by the formula $(R_{(1-x)}Zr_x)_a(Fe_{(1-y)}Co_y)_bT_cM_d$. In the above-described formula, T represents one or more elements selected from the group consisting of Ti, V, Mo, and W, M represents one or more elements selected from the group consisting of unavoidable impurity elements, Al, Cr, Cu, Ga, Ag, and Au, $0\leq x\leq0.5$, $0\leq y\leq0.6$, $4\leq a\leq20$, $b=100-a-c-d$, $0<c<7$, and $0\leq d\leq1$. This molten alloy 12 is supplied to a tundish 13 at a fixed supply rate. The molten alloy 12 supplied to the tundish 13 is supplied to a cooling roller 14 from an end of the tundish 13 due to its own weight.

Here, the tundish 13 is made of a ceramic, can temporarily store the molten alloy 12 which is continuously supplied from the melting furnace 11 at a predetermined flow rate, and can rectify the flow of the molten alloy 12 to the cooling roller 14. In addition, the tundish 13 has a function of adjusting the temperature of the molten alloy 12 immediately before the molten alloy 12 reaches the cooling roller 14.

The cooling roller 14 is formed of a material having high thermal conductivity such as copper or chromium, and, for example, the roller surface is plated with chromium to prevent corrosion with the molten alloy having a high temperature. This roller can be rotated by a drive device (not shown) at a predetermined rotating speed in a direction indicated by an arrow. By controlling the rotating speed, the cooling rate of the molten alloy can be controlled to be $1\times10^2$ K/sec to $1\times10^7$ K/sec.

The molten alloy 12 which is cooled and solidified on the outer periphery of the cooling roller 14 is peeled off from the cooling roller 14 as flaky solidified alloy 15. The solidified alloy 15 is crushed and collected by a collection device.

Further, the method according to the embodiment of the invention may further include a step of performing a heat treatment on particles obtained in the above-described step at 800° C. to 1300° C. for 2 hours to 120 hours. Due to this heat treatment, the $ThMn_{12}$ phase is made to be homogeneous, and both characteristics of anisotropy field and saturation magnetization are further improved.

The collected alloy is crushed, and A (A represents one or more elements selected from the group consisting of N, C, H, and P) is caused to penetrate into the alloy. Specifically, when nitrogen is used as A, the alloy is nitrided by performing a heat treatment thereon using nitrogen gas or ammonia gas as a nitrogen source at a temperature of 200° C. to 600° C. for 1 hour to 24 hours. When carbon is used as A, the alloy is carbonized by performing a heat treatment thereon using $C_2H_2$ ($CH_4$, $C_3H_8$, or CO) gas or thermally decomposed gas of methanol as a carbon source at a temperature of 300° C. to 600° C. for 1 hour to 24 hours. In addition, solid carburizing using carbon powder or carburizing using molten salt such as KCN or NaCN can be performed. In regard to H and P, typical hydrogenation and phosphorization can be performed.

(Crystal Structure)

Figure 3:
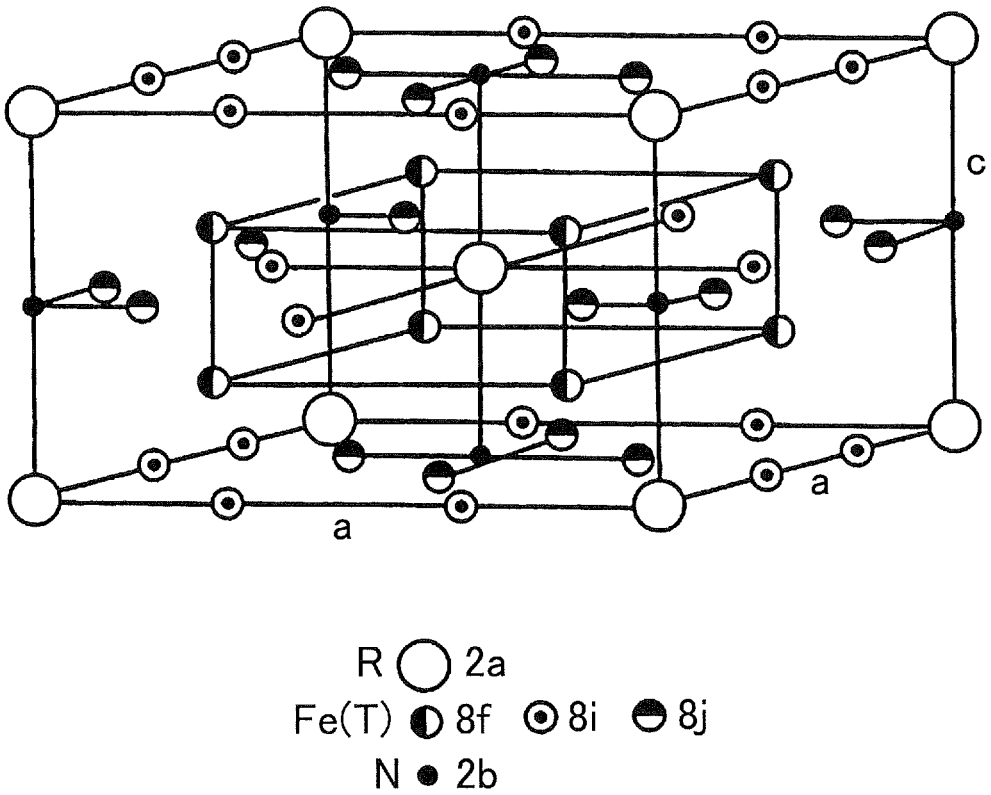
FIG. 3 is a perspective view schematically showing a $ThMn_{12}$ type crystal structure.
Figure 4A:
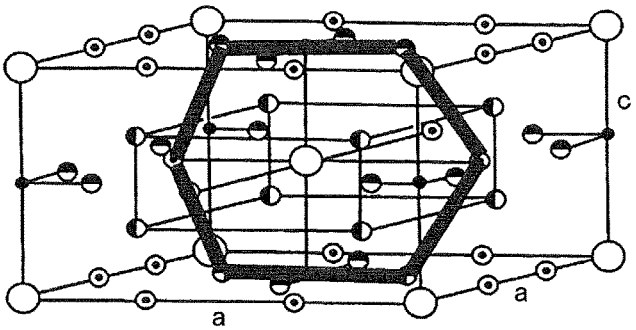
FIGS. 4A to 4C are perspective views schematically showing hexagons A, B, and C in the $ThMn_{12}$ type crystal structure.
Figure 4B:
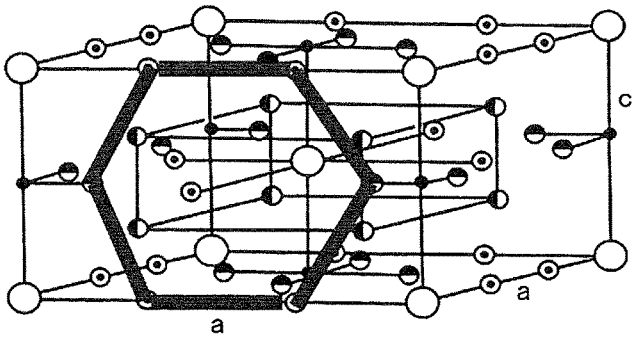
Figure 4C:
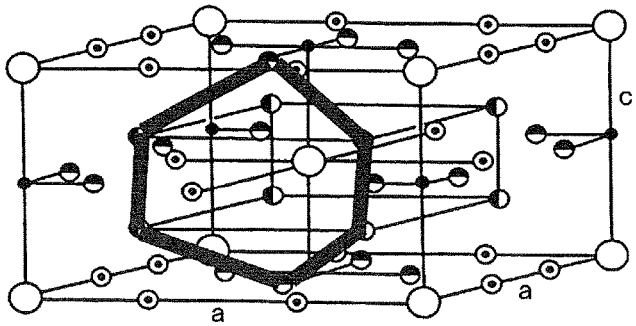
Figure 5A:
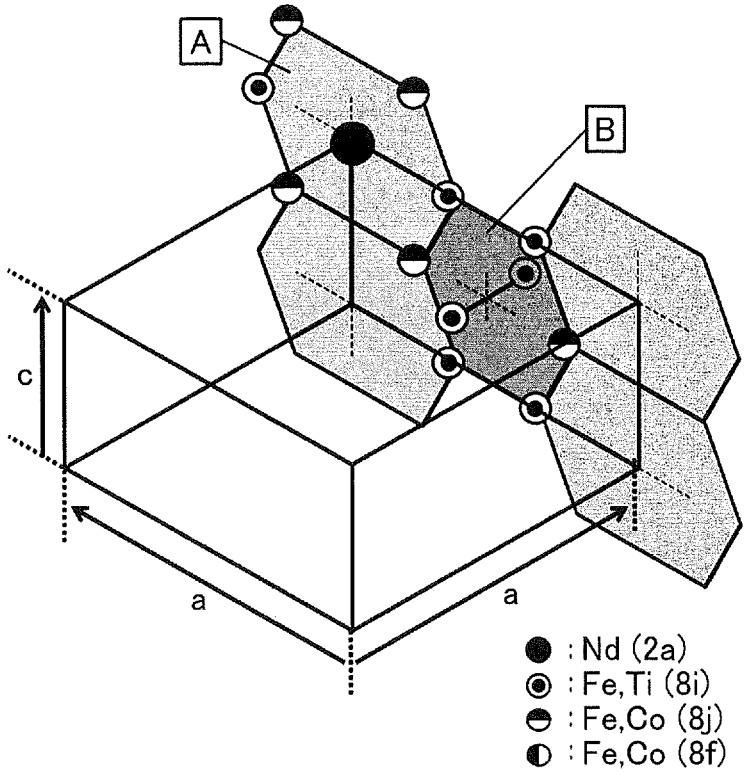
FIGS. 5A and 5B are perspective views schematically showing the hexagons A, B, and C in the $ThMn_{12}$ type crystal structure.
Figure 5B:
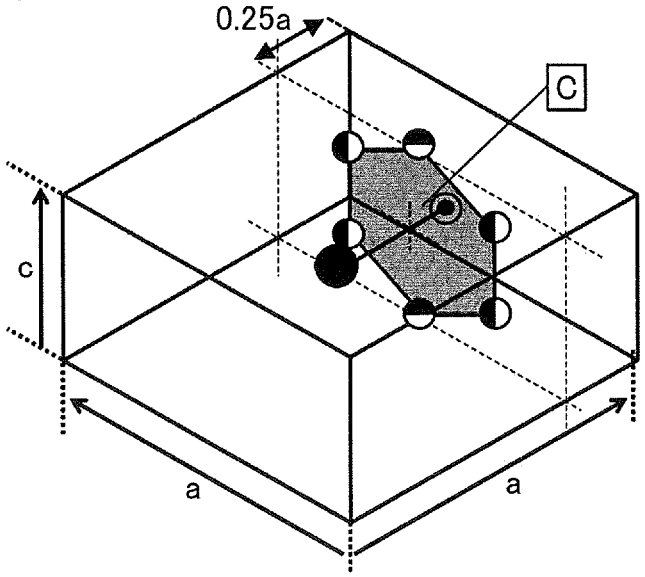

The magnetic compound according to the embodiment of the invention is a rare earth element-containing magnetic compound having a $ThMn_{12}$ type tetragonal crystal structure shown in FIG. 3. A lattice constant a of the crystal structure is within a range of 0.850 nm to 0.875 nm, a lattice constant c of the crystal structure is within a range of 0.480 nm to 0.505 nm, and a lattice volume of the crystal structure is within a range of 0.351 $nm^3$ to 0.387 $nm^3$. Further, as shown in FIGS. 4A to 4C and 5A and 5B, hexagons A, B, and C are defined as follows: the hexagon A is defined as a six-membered ring centering on a rare earth atom, which is formed of Fe (8i) and Fe(8j) sites (FIGS. 4A and 5A); the hexagon B is defined as a six-membered ring which includes Fe (8i) and Fe(8j) sites in which Fe (8i)-Fe (8i) dumbbells form two sides facing each other (FIGS. 4B and 5A); and the hexagon C is defined as a six-membered ring which is formed of Fe (8j) and Fe(8f) sites and whose center is positioned on a straight line connecting Fe (8i) and a rare earth atom to each other (FIGS. 4C and 5B). At this time, a length Hex (A) of the hexagon A in a direction of axis a is shorter than 0.611 nm, an average distance between Fe (8i) and Fe (8i) in the hexagon A is 0.254 nm to 0.288 nm, an average distance between Fe (8j) and Fe (8j) in the hexagon B is 0.242 nm to 0.276 nm, and an average distance between Fe (8f) and Fe (8f) facing each other with the center of the hexagon C interposed therebetween in the hexagon C is 0.234 nm to 0.268 nm.

Figure 6:
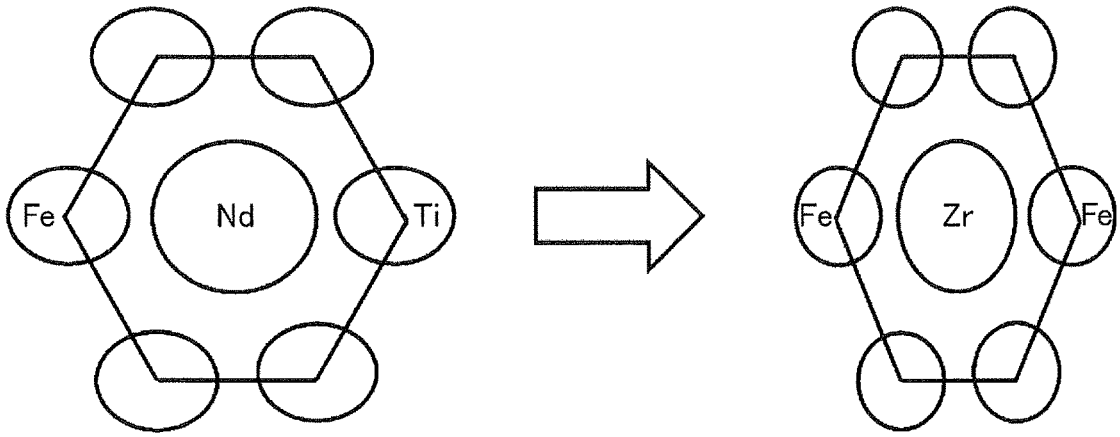
FIG. 6 is a perspective view schematically showing a change in the size of the hexagons.

As shown in FIG. 6, as compared to in a magnetic compound of the related art, in the magnetic compound according to the embodiment of the invention, the amount of T (for example, Ti) as a stable element is small, and the shape and dimension balance of the hexagon A deteriorates when Ti having a large atomic radius is substituted with Fe. However, this deterioration is compensated for by Zr having a smaller atomic radius than Nd.

Further, the magnetic powder according to the embodiment of the invention is represented by the formula $(R_{(1-x)}Zr_x)_a(Fe_{(1-y)}Co_y)_bT_cM_dA_e$ and includes a $ThMn_{12}$ type crystal structure, in which a volume percentage of an α-(Fe,Co) phase is 20% or lower. In the above-described formula, R represents one or more rare earth elements, T represents one or more elements selected from the group consisting of Ti, V, Mo, and W, M represents one or more elements selected from the group consisting of unavoidable impurity elements, Al, Cr, Cu, Ga, Ag, and Au, A represents one or more elements selected from the group consisting of N, C, H, and P, $b=100-a-c-d$, $0<c\leq7$, $0\leq d\leq1$, and $1\leq e\leq18$.

Examples 1 to 5 and Comparative Examples 2 to 5

Figure 15:
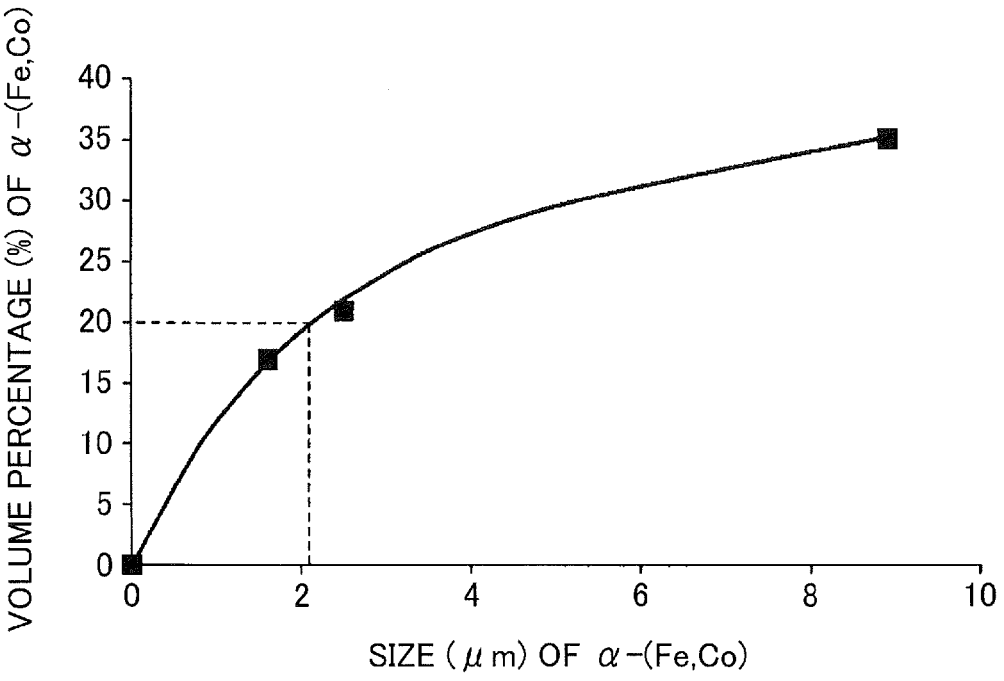
FIG. 15 is a graph showing a relationship between the size of an α-(Fe,Co) phase in a sample before nitriding and the volume percentage of the α-(Fe,Co) phase in the sample after nitriding which are measured from an SEM image.
Figure 17:
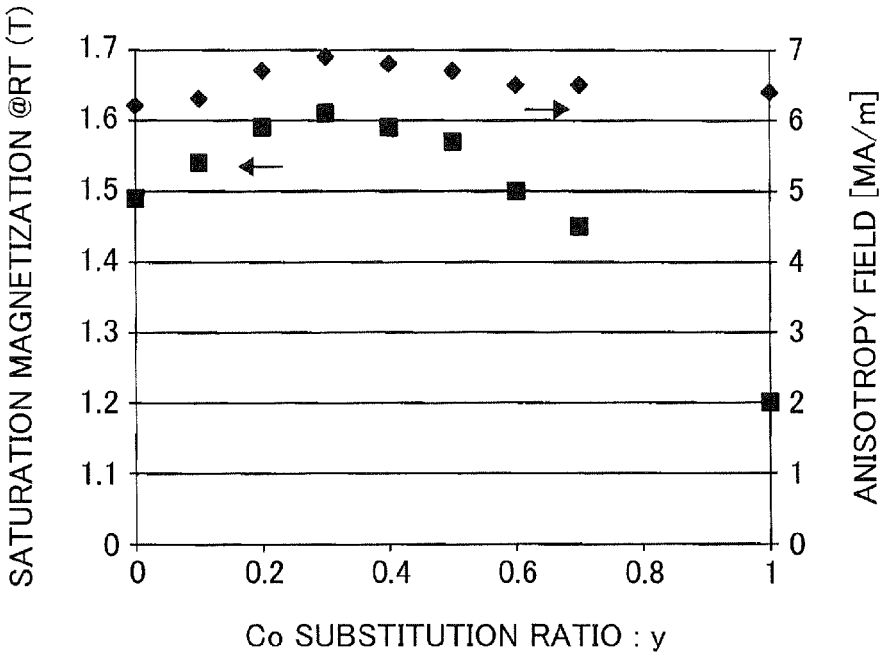
FIG. 17 is a graph showing a relationship between a Co substitution ratio and magnetic characteristics in each of Examples 8 to 15 and Comparative Example 13.
Figure 18:
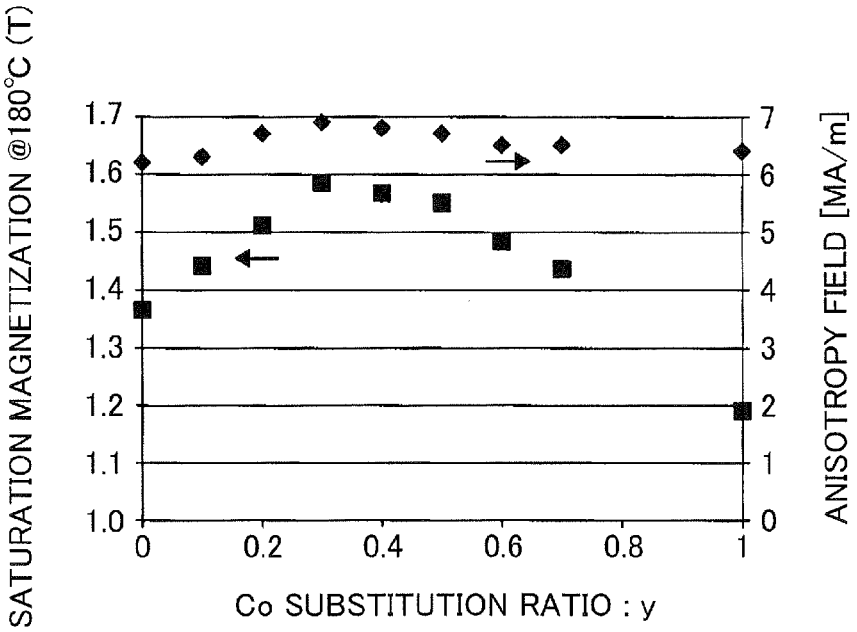
FIG. 18 is a graph showing a relationship between a Co substitution ratio and magnetic characteristics in each of Examples 8 to 15 and Comparative Example 13.
Figure 19:
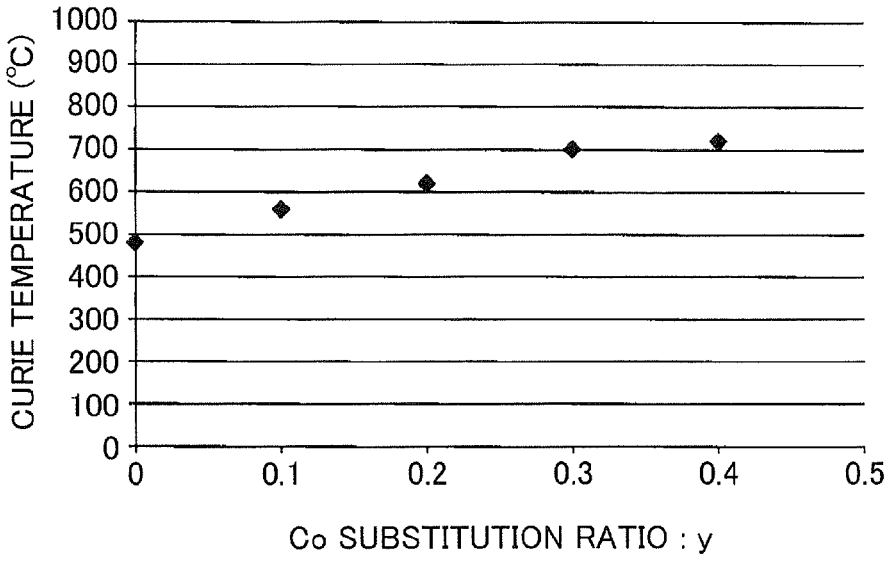
FIG. 19 is a graph showing a relationship between a Co substitution ratio and a Curie temperature in each of Examples 8 to 15 and Comparative Example 13.

Molten alloys for preparing compounds having a composition shown in FIG. 7 below were prepared. Each of the molten alloys was quenched at a rate of $10^4$ K/sec using a strip casting method to prepare a quenched ribbon. The quenched ribbon underwent a heat treatment in an Ar atmosphere at 1200° C. for 4 hours. Next, in an Ar atmosphere, the ribbon was crushed using a cutter mill, and particles having a particle size of 30 μm to 75 μm were collected. From each of SEM images (backscattered electron images) of the obtained particles, the size and area ratio of an α-(Fe,Co) phase were measured, and a volume percentage was calculated from the expression Area Ratio=Volume Percentage. Next, the obtained particles were nitrided in nitrogen gas having a purity of 99.99% at 450° C. for 4 hours. The obtained particles underwent magnetic characteristic evaluation (VSM) and crystal structure analysis (XRD). Further, the volume percentage of the α-(Fe,Co) phase after nitriding was calculated based on a graph shown in FIG. 15, the graph showing a relationship between the size of the α-(Fe,Co) phase in the sample before nitriding and the volume percentage of the α-(Fe,Co) phase in the sample after nitriding which were measured from the SEM image. The results are shown in FIGS. 7, 8, and 9.

Comparative Example 1

Molten alloy for preparing a compound having a composition shown in FIG. 7 below was prepared. The molten alloy was quenched at a rate of $10^4$ K/sec using a strip casting method to prepare a quenched ribbon. Next, in an Ar atmosphere, the alloy having undergone hydrogen embrittlement was crushed using a cutter mill, and particles having a particle size of 30 μm or less were collected. The obtained particles were press-formed in a magnetic field, were sintered at 1050° C. for 3 hours, and underwent a heat treatment at 900° C. for 1 hour and at 600° C. for 1 hour. The obtained magnet underwent magnetic characteristic evaluation (VSM) and crystal structure analysis (XRD), and the results are shown in FIGS. 7, 8, and 9.

Figure 8:
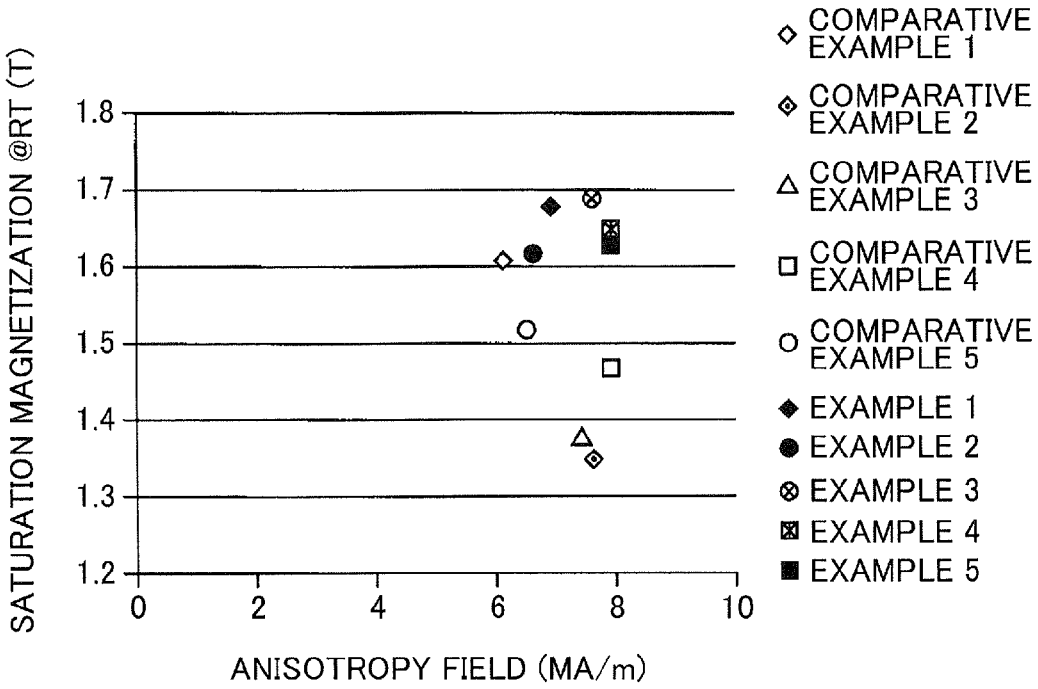
FIG. 8 is a graph showing the measurement results of saturation magnetization (room temperature) and anisotropy field of Examples 1 to 5 and Comparative Examples 1 to 5.
Figure 9:
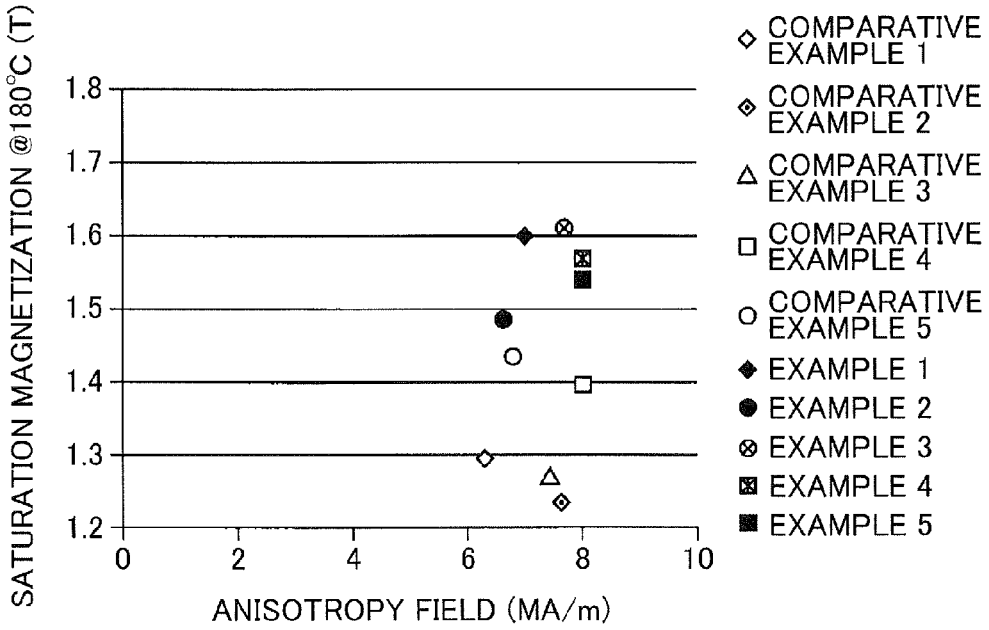
FIG. 9 is a graph showing the measurement results of saturation magnetization (180° C.) and anisotropy field of Examples 1 to 5 and Comparative Examples 1 to 5.

As clearly seen from the results of FIGS. 7, 8, and 9, when the Ti content was lower than 7 at %, saturation magnetization was improved (in particular, at a high temperature), and higher anisotropy field and higher saturation magnetization than those of a NdFeB magnet were exhibited (Examples 1 to 5). An increase in saturation magnetization caused by Co addition was observed, in particular, at a high temperature (for comparison to Examples 1 and 2).

Examples 6 and 7

Figure 10:
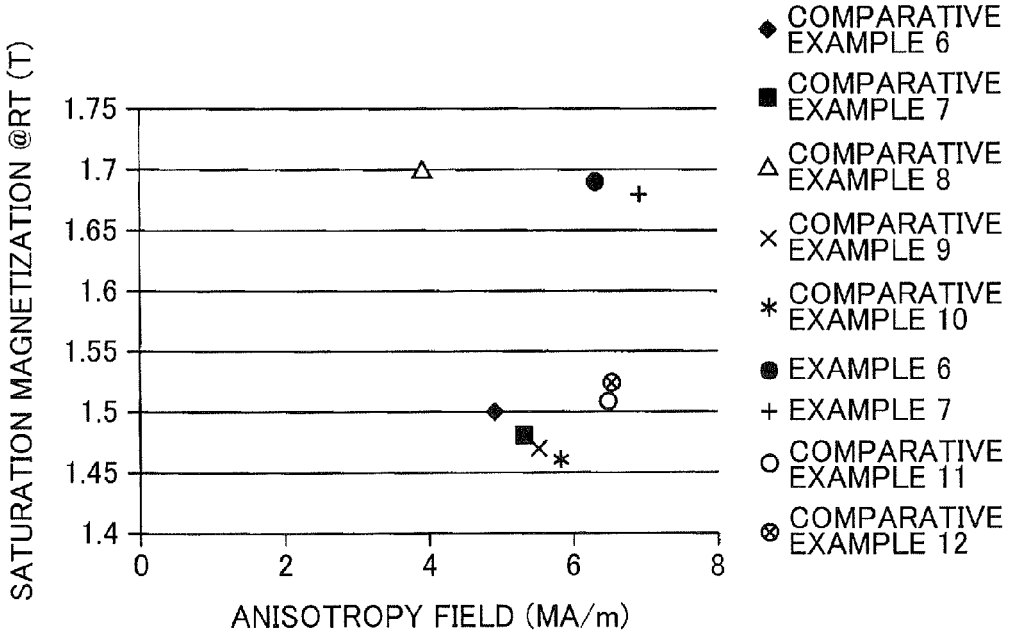
FIG. 10 is a graph showing the measurement results of saturation magnetization (room temperature) and anisotropy field of Examples 6 and 7 and Comparative Examples 6 to 12.
Figure 11:
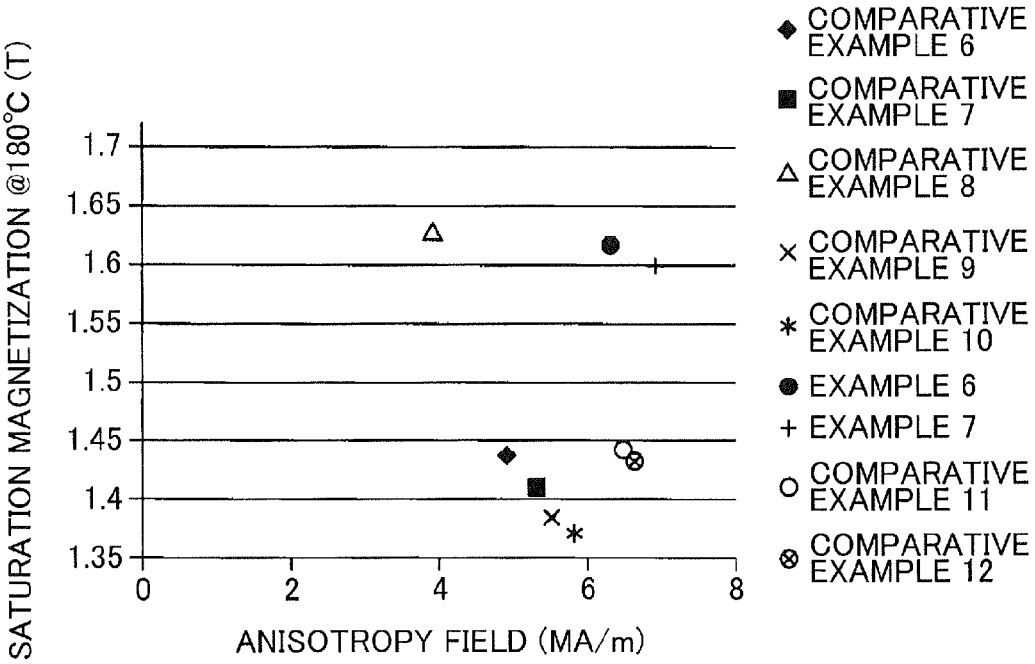
FIG. 11 is a graph showing the measurement results of saturation magnetization (180° C.) and anisotropy field of Examples 6 and 7 and Comparative Examples 6 to 12.

Molten alloys for preparing compounds having a composition shown in FIG. 12 below were prepared. Each of the molten alloys was quenched at a rate of $10^4$ K/sec using a strip casting method to prepare a quenched ribbon. In Example 7, in an Ar atmosphere, the quenched ribbon underwent a heat treatment at 1200° C. for 4 hours. Next, in an Ar atmosphere, the ribbon was crushed using a cutter mill, and particles having a particle size of 30 μm to 75 μm were collected. Regarding each of the particles, the size and area ratio of the α-(Fe,Co) phase were measured and the volume percentage thereof was calculated using the same method as in Example 1. Next, the obtained particles were nitrided in nitrogen gas having a purity of 99.99% at 450° C. for 4 hours. The obtained particles underwent magnetic characteristic evaluation (VSM) and crystal structure analysis (XRD). Further, the volume percentage of the α-(Fe,Co) phase after nitriding was calculated using the same method as in Example 1. The results are shown in FIGS. 10, 11, and 12.

Comparative Examples 6 to 10

Molten alloys for preparing compounds having a composition shown in FIG. 12 below were prepared by arc melting. Each of the molten alloys was quenched at a rate of 50 K/sec using a strip casting method to prepare a quenched ribbon. In Comparative Examples 7, 8 and 10, in an Ar atmosphere, the quenched ribbon underwent a heat treatment at 1100° C. for 4 hours. Next, in an Ar atmosphere, the ribbon was crushed using a cutter mill, and particles having a particle size of 30 μm to 75 μm were collected. The obtained particles were nitrided in nitrogen gas having a purity of 99.99% at 450° C. for 4 hours. The obtained particles underwent magnetic characteristic evaluation (VSM) and crystal structure analysis (XRD), and the results thereof are shown in FIGS. 10, 11, and 12 together with the measurement results of the size and volume percentage of the α-(Fe,Co) phase which were measured using the same method as in Example 1.

Comparative Examples 11 and 12

Molten alloys for preparing compounds having a composition shown in FIG. 12 below were prepared. Each of the molten alloys was quenched at a rate of $10^4$ K/sec using a strip casting method to prepare a quenched ribbon. In Comparative Example 12, in an Ar atmosphere, the quenched ribbon underwent a heat treatment at 1100° C. for 4 hours. Next, in an Ar atmosphere, the ribbon was crushed using a cutter mill, and particles having a particle size of 30 μm to 75 μm were collected. The obtained particles were nitrided in nitrogen gas having a purity of 99.99% at 450° C. for 4 hours. The obtained particles underwent magnetic characteristic evaluation (VSM) and crystal structure analysis (XRD), and the results thereof are shown in FIGS. 10, 11, and 12 together with the measurement results of the size and volume percentage of the α-(Fe,Co) phase which were measured using the same method as in Example 1.

Figure 13:
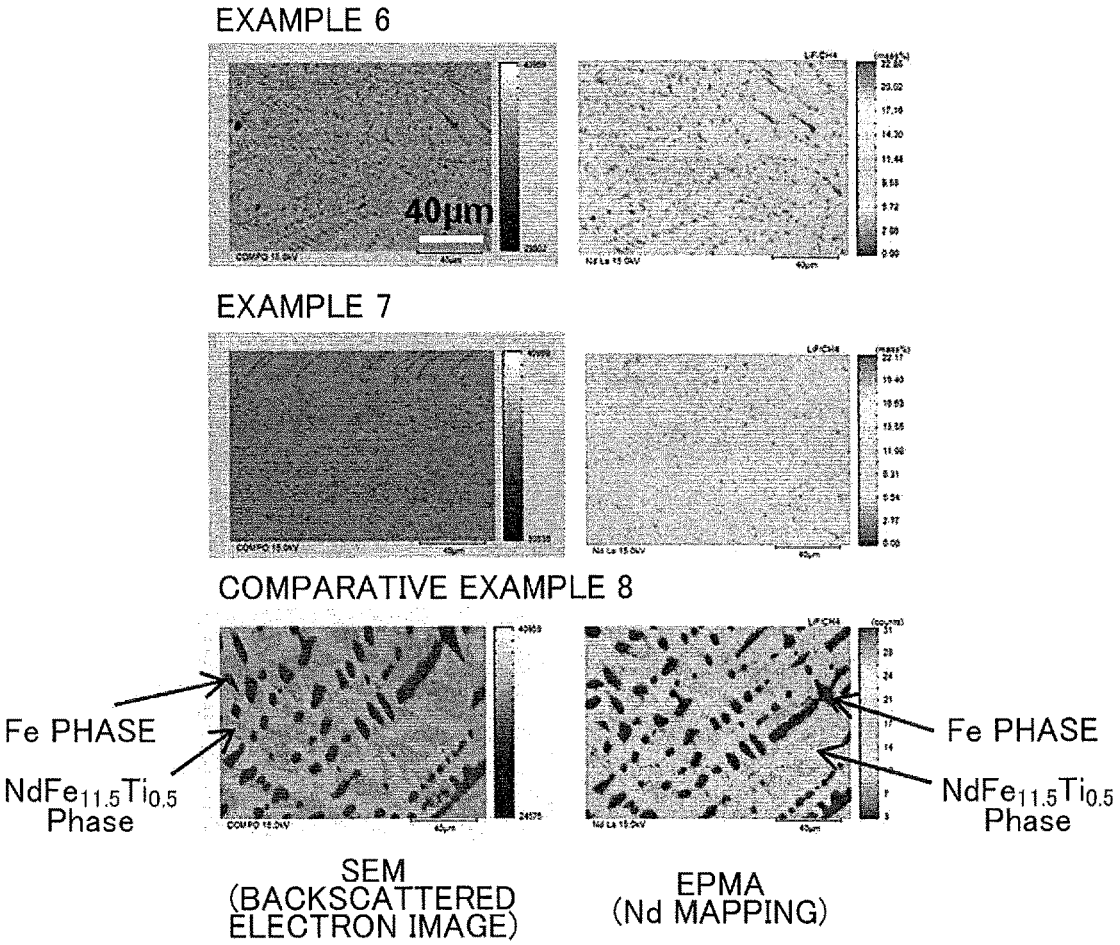
FIG. 13 shows backscattered electron images of particles obtained in Examples 6 and 7 and Comparative Example 8.
Figure 14:
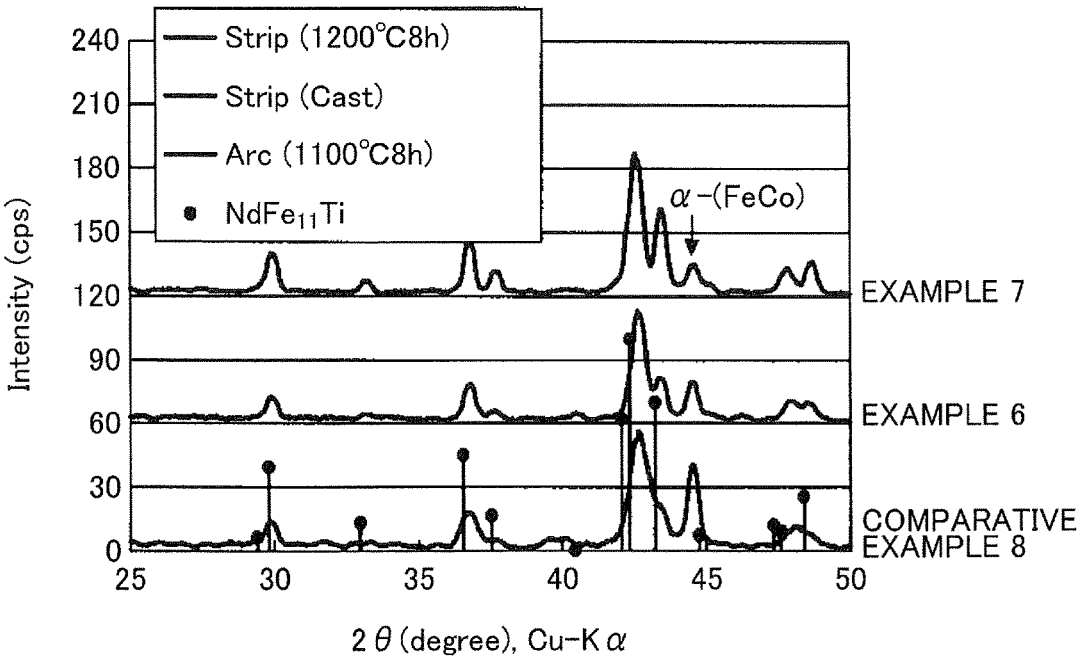
FIG. 14 is a graph showing the XRD results of the particles obtained in Examples 6 and 7 and Comparative Example 8.

FIG. 13 shows backscattered electron images of particles obtained in Examples 6 and 7 and Comparative Example 8. In Comparative Example 8 in which arc melting was performed, a large amount of Fe was deposited and the structure was heterogeneous. On the other hand, in Examples in which quenching was performed, the segregation of the structure was not observed in EPMA. FIG. 14 shows the XRD results of the particles obtained in Examples 6 and 7 and Comparative Example 8. It was found that the peak intensities of α-Fe became lower in order from Comparative Example 8 (arc melting)→Example 6 (quenching)→Example 7 (quenching+homogenization heat treatment).

It is considered from the above results that, due to quenching, the α-(Fe,Co) phase was refined, the amount thereof deposited was reduced, and the entire structure was refined and homogeneously dispersed; as a result, characteristics were further improved. In addition, it is considered that, by further performing the heat treatment after cooling, the homogenization of the refined structure progressed, and the amount of the α-(Fe,Co) phase was reduced; as a result, characteristics were improved. In this way, even when the Ti content was reduced from 7 at % to 4 at %, due to the quenching treatment and the homogenization heat treatment, the deposition of the α-(Fe,Co) phase was suppressed, and anisotropy field was exhibited as in the related art. As a result, a magnetic compound having a $ThMn_{12}$ type crystal structure in which high characteristics of anisotropy field and saturation magnetization were realized was able to be prepared.

Examples 8 to 15 and Comparative Example 13

Molten alloys for preparing compounds having a composition shown in FIG. 16 below were prepared. Each of the molten alloys was quenched at a rate of $10^4$ K/sec using a strip casting method to prepare a quenched ribbon. The quenched ribbon underwent a heat treatment in an Ar atmosphere at 1200° C. for 4 hours (a cobalt content y in $Nd_{7.7}(Fe_{(1-y)}Co_y)_{86.1}Ti_{6.2}N_{7.7}$ was changed). Next, in an Ar atmosphere, the ribbon was crushed using a cutter mill, and particles having a particle size of 30 μm or less were collected. The obtained particles were nitrided in nitrogen gas having a purity of 99.99% at 450° C. for 4 hours to 24 hours. The obtained particles underwent magnetic characteristic evaluation (VSM) and crystal structure analysis (XRD). The results are shown in FIGS. 16 and 17 to 19.

As can be seen from the experiment results, anisotropy field exhibits high values without being substantially affected by the Co substitution ratio. On the other hand, saturation magnetization was the maximum at Co substitution ratio=0.3 and decreased at y=0.7 or higher. Further, the Curie point increased along with an increase in Co content (when y=0.5 or higher, the Curie point was not able to be measured due to the limitation of the apparatus). Accordingly, it was found that a range of $0 \leq y \leq 0.7$ is preferable in regard to Co.

Figure 20:
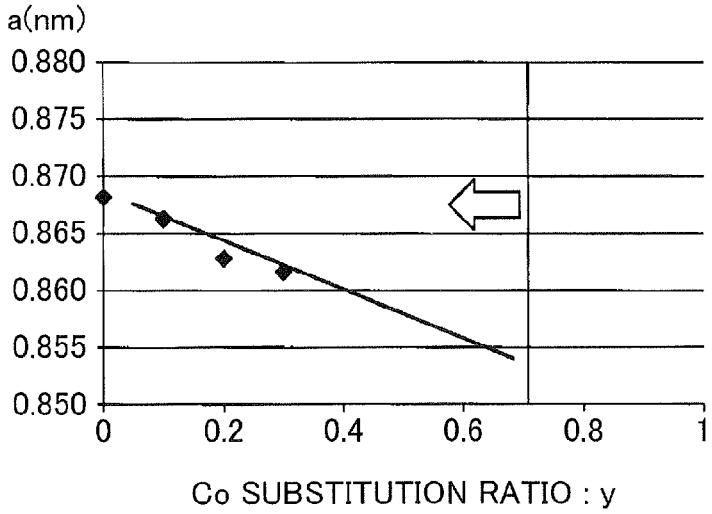
FIG. 20 is a graph showing a relationship between a Co substitution ratio and a lattice constant a of a crystal structure in each of Examples 8 to 15 and Comparative Example 13.
Figure 21:
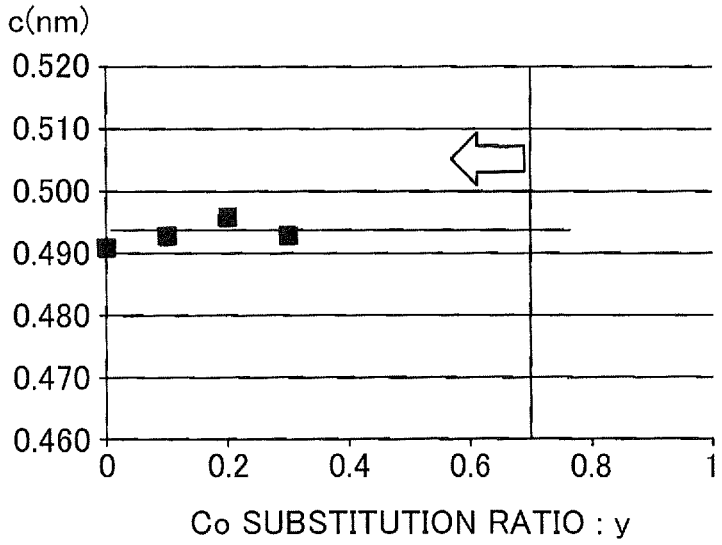
FIG. 21 is a graph showing a relationship between a Co substitution ratio and a lattice constant c of a crystal structure in each of Examples 8 to 15 and Comparative Example 13.
Figure 22:
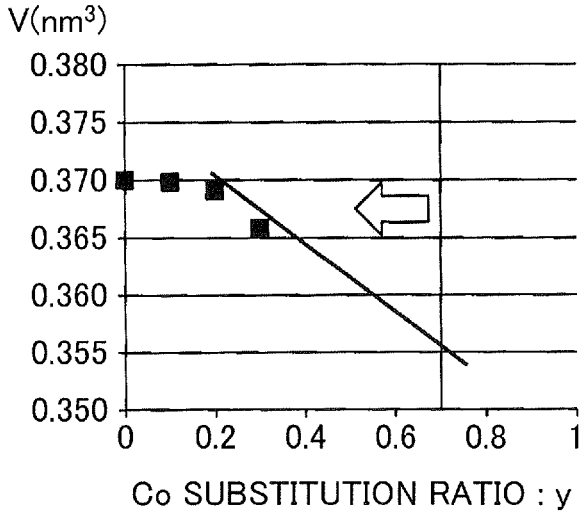
FIG. 22 is a graph showing a relationship between a Co substitution ratio and a lattice volume V in each of Examples 8 to 15 and Comparative Example 13.

FIGS. 20 to 22 show relationships between a Co substitution ratio and lattice constants a and c and a lattice volume V of a crystal structure. From the above results, the following was found: the lattice constant a of the crystal structure is within a range of 0.850 nm to 0.875 nm, the lattice constant c of the crystal structure is within a range of 0.480 nm to 0.505 nm, and the lattice volume V of the crystal structure is within a range of 0.351 $nm^3$ to 0.387 $nm^3$.

Figure 23:
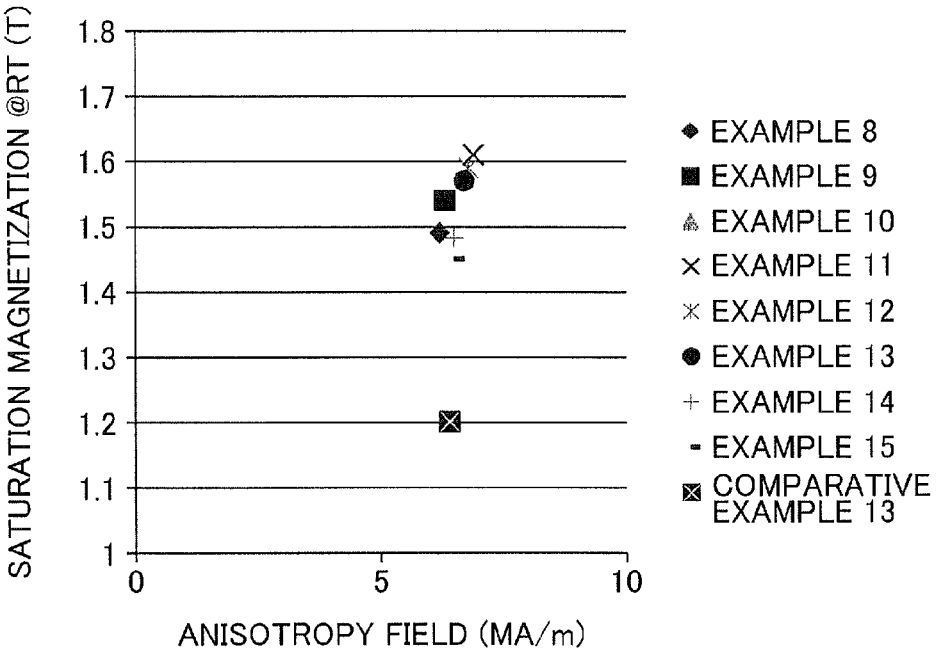
FIG. 23 is a graph showing the measurement results of saturation magnetization (room temperature) and anisotropy field of Examples 8 to 15 and Comparative Example 13.
Figure 24:
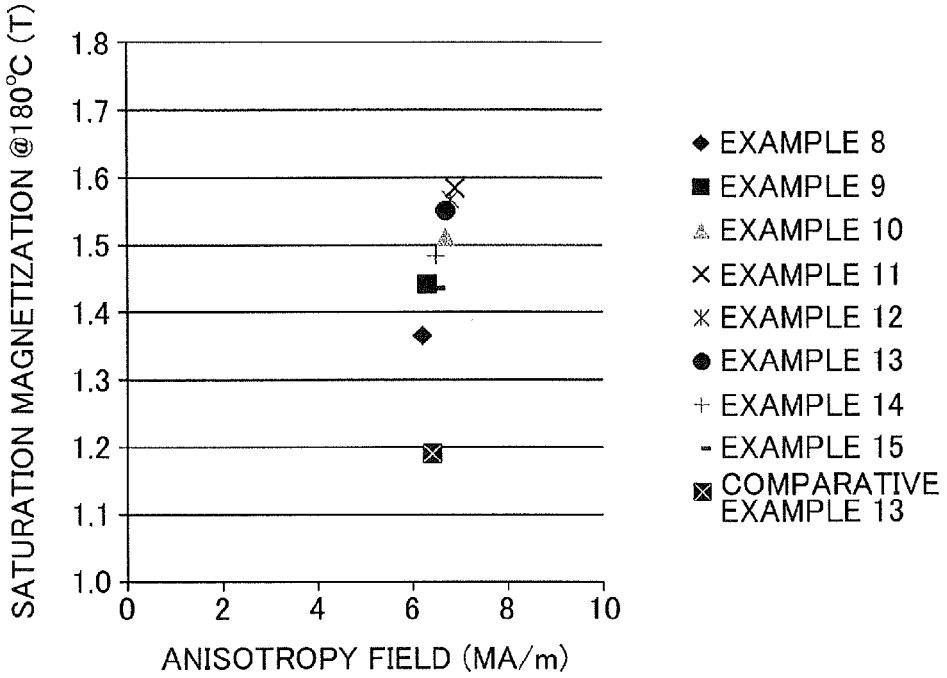
FIG. 24 is a graph showing the measurement results of saturation magnetization (180° C.) and anisotropy field of Examples 8 to 15 and Comparative Example 13.

FIGS. 23 and 24 show a relationship between anisotropy field and saturation magnetization. In the samples of Examples according to the embodiment of the invention, sufficiently high magnetic characteristics were obtained.

Here, in the crystal structure, hexagons A, B, and C were defined as follows: the hexagon A was defined as a six-membered ring centering on a rare earth atom R, which is formed of Fe (8i) and Fe(8j) sites; the hexagon B was defined as a six-membered ring which included Fe (8i) and Fe(8j) sites in which Fe (8i)-Fe (8i) dumbbells formed two sides facing each other; and the hexagon C was defined as a six-membered ring which is formed of Fe (8j) and Fe(8f) sites and whose center was positioned on a straight line connecting Fe (8i) and a rare earth atom to each other. At this time, it was found from FIG. 7 that a length Hex(A) of the hexagon A in a direction of axis a was shorter than 0.611 nm which was a value of a composition $NdFe_{11}TiN$ ($Nd_{7.7}Fe_{92.3}Ti_{7.7}N_{7.7}$).

Example 16 and Comparative Examples 14 to 17

Molten alloys for preparing compounds having a composition shown in FIG. 25 below were prepared. Each of the molten alloys was quenched at a rate of $10^4$ K/sec using a strip casting method to prepare a quenched ribbon. The quenched ribbon underwent a heat treatment in an Ar atmosphere at 1200° C. for 4 hours (a titanium content c in $Nd_{7.7}(Fe_{0.75}Co_{0.25})_{92.30-c}Ti_cN_{7.7}$ was changed). Next, in an Ar atmosphere, the ribbon was crushed using a cutter mill, and particles having a particle size of 30 μm or less were collected. The obtained particles were nitrided in nitrogen gas having a purity of 99.99% at 450° C. for 4 hours. The obtained particles underwent magnetic characteristic evaluation (VSM) and crystal structure analysis (XRD). The results are shown in FIGS. 25 and 27.

Figure 27:
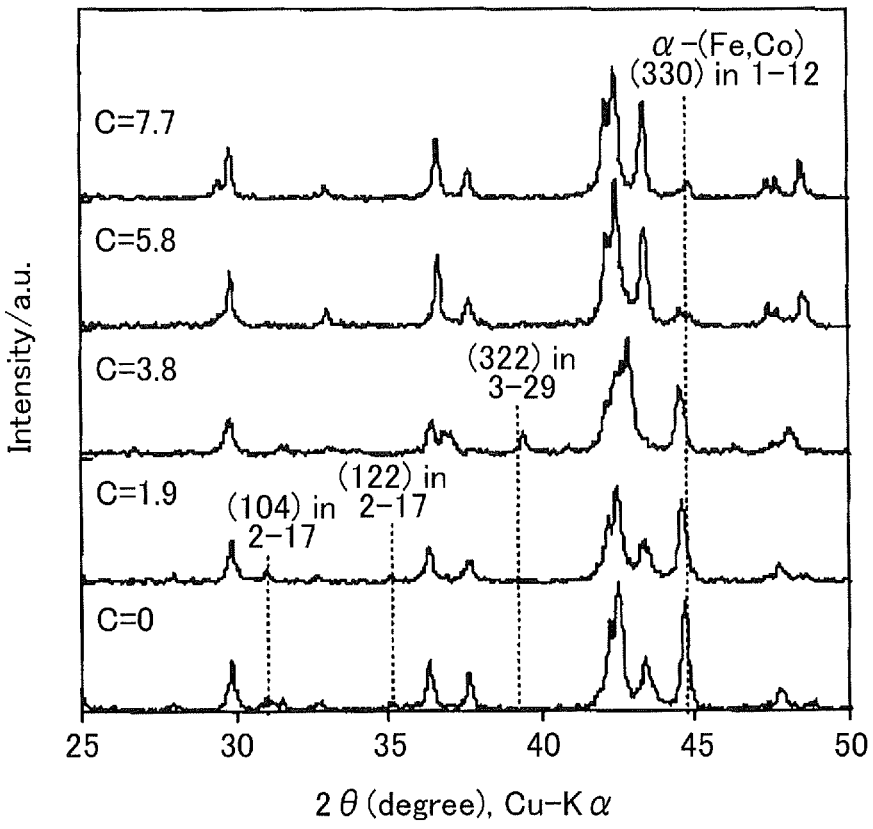
FIG. 27 is a graph showing the XRD results of Example 16 and Comparative Examples 14 to 17.

It was found from the results of crystal structure analysis using XRD in FIG. 27 that, when the Ti content was 5.8 at % or higher, a 1-12 phase was formed. On the other hand, when the Ti content was 3.8 at %, a 3-29 phase was formed, and when the Ti content was 1.9 at % or lower, a 2-17 phase was formed. In addition, FIG. 26 below shows a relationship between a change in Ti content and a change in crystal structure.

Example 17 to 27 and Comparative Examples 18 to 31

Figure 30:
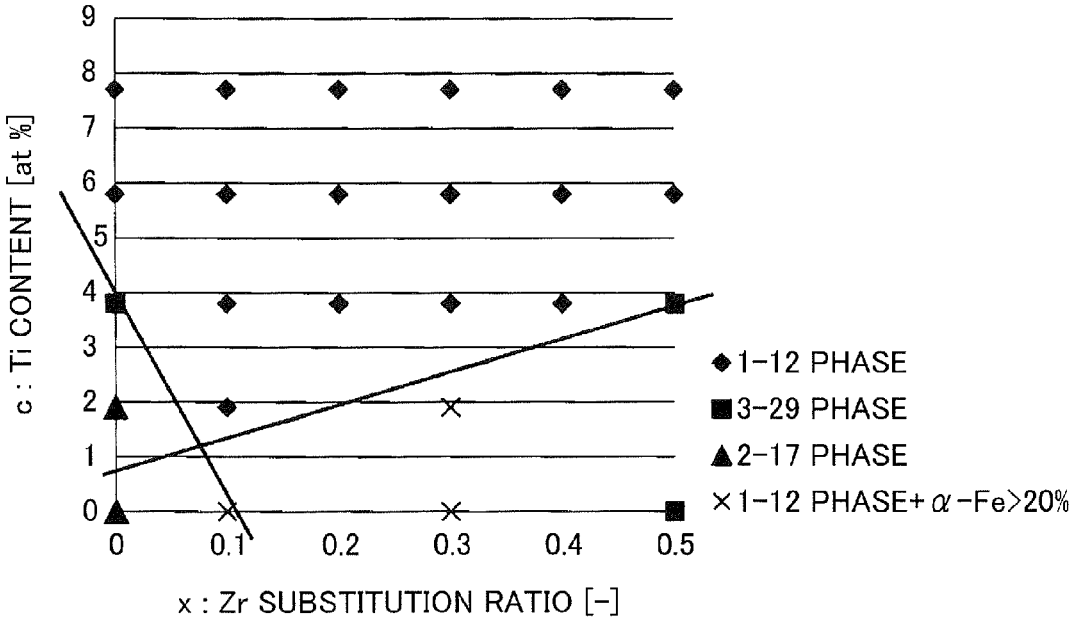
FIG. 30 is a graph showing a relationship between a Ti content and a Zr change in each of Examples 17 to 27 and Comparative Examples 18 to 31.
Figure 32:
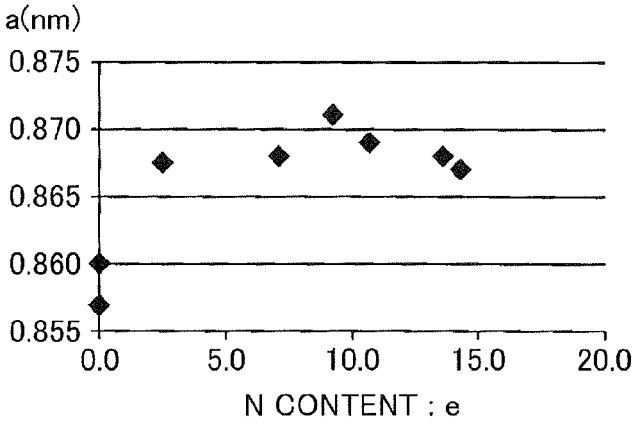
FIG. 32 is a graph showing a relationship between a N content and a lattice constant a of a crystal structure in each of Examples 28 to 33 and Comparative Examples 32 and 33.
Figure 33:
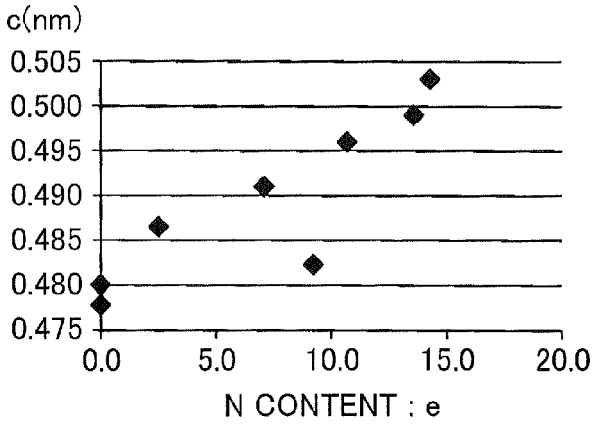
FIG. 33 is a graph showing a relationship between a N content and a lattice constant c of a crystal structure in each of Examples 28 to 33 and Comparative Examples 32 and 33.
Figure 34:
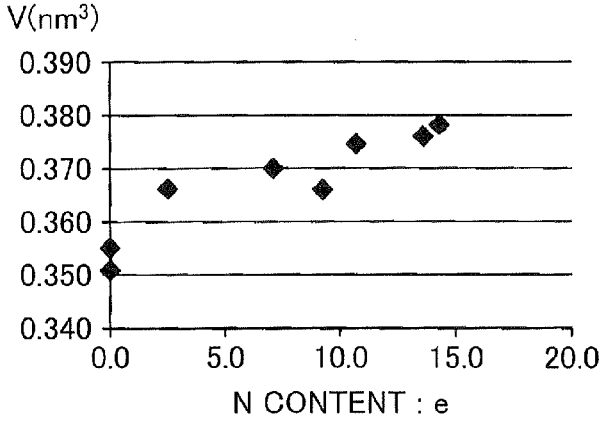
FIG. 34 is a graph showing a relationship between a N content and a lattice volume V in each of Examples 28 to 33 and Comparative Examples 32 and 33.

Molten alloys for preparing compounds having a composition shown in FIGS. 28 and 29 below were prepared. Each of the molten alloys was quenched at a rate of $10^4$ K/sec using a strip casting method to prepare a quenched ribbon. The quenched ribbon underwent a heat treatment in an Ar atmosphere at 1200° C. for 4 hours (a ratio x of Zr substitution and a titanium content c in $(Nd_{(7.7-x)}Zr_x)Fe_{0.75}Co_{0.25})_{92.30-c}Ti_cN_{7.7}$ were changed). Next, in an Ar atmosphere, the ribbon was crushed using a cutter mill, and particles having a particle size of 30 μm or less were collected. The obtained particles were nitrided in nitrogen gas having a purity of 99.99% at 450° C. for 4 hours to 16 hours. The obtained particles underwent magnetic characteristic evaluation (VSM) and crystal structure analysis (XRD). The results are shown in FIGS. 28, 29, and 30.

It was found from the results of FIGS. 28 and 29 that the ability to form the 1-12 phase decreases along with a decrease in Ti content and is improved along with an increase in Zr addition amount. It was clearly found from the results of FIG. 30 that, in a region where the 1-12 phase can be formed, a relationship between the ratio of Zr substitution x and the Ti content c satisfies a region ($0<c<7$, $x \geq 0$) surrounded by $c>-38x+3.8$ and $c>6.3x+0.65$. The reason for this is presumed to be as follows. As shown in FIG. 6, when the Ti content was reduced, Ti atoms in the 8i site of hexagon A are substituted with Fe atoms having a small atomic radius, and thus the size balance of the hexagon A is decreased. Therefore, the 1-12 phase is not stably formed. However, the size balance is compensated for by substitution of Zr atoms having a smaller atomic radius than Nd atoms. As a result, the 1-12 phase can be formed irrespective of a decrease in Ti content.

Examples 28 to 33 and Comparative Examples 32 to 33

Molten alloys for preparing compounds having a composition shown in FIG. 31 below were prepared. Each of the molten alloys was quenched at a rate of $10^4$ K/sec using a strip casting method to prepare a quenched ribbon. The quenched ribbon underwent a heat treatment in an Ar atmosphere at 1200° C. for 4 hours. Next, in an Ar atmosphere, the ribbon was crushed using a cutter mill, and particles having a particle size of 30 μm or less were collected. The obtained particles were nitrided in nitrogen gas having a purity of 99.99% at 450° C. for 4 hours (a nitrogen content e was changed in $Nd_{7.7}(Fe_{0.75}Co_{0.25})_{86.5}Ti_{5.8}N_e$ and $Nd_{7.7}Fe_{86.5}Ti_{5.8}N_e$). The obtained particles underwent magnetic characteristic evaluation (VSM) and crystal structure analysis (XRD). The results are shown in FIGS. 31 to 34.

It was found that the lattice constant was increased in directions of axes a and c along with an increase in N content. In addition, it was found that nitrogen was introduced in amount of up to 15.4 at % without breaking the crystal structure. It was found as described above that saturation magnetization and anisotropy field were increased along with an increase in N content.

What is claimed is:

1. A magnetic compound represented by $(R_{(1-x)}Zr_x)_a(Fe_{(1-y)}Co_y)_bT_cM_dA_e$, the magnetic compound comprising a $ThMn_{12}$ type crystal structure, wherein a volume percentage of an α-(Fe,Co) phase is 20% or lower, R represents one or more rare earth elements, T represents one or more elements selected from the group consisting of Ti, V, Mo, and W, M represents one or more elements selected from the group consisting of unavoidable impurity elements, Al, Cr, Cu, Ga, Ag, and Au, A represents one or more elements selected from the group consisting of N, C, H, and P, $0x \leq 0.5$, $0 \leq y \leq 0.6$, $4 \leq a \leq 20$, $b=100-a-c-d$, $0<c<7$, $0 \leq d \leq 1$, and $1 \leq e \leq 18$.

2. The magnetic compound according to claim 1, wherein $0 \leq x \leq 0.3$, and $7 \leq e \leq 14$.

3. The magnetic compound according to claim 1, wherein a region surrounded by $0<c<7$, $x \geq 0$, $c>-38x+3.8$ and $c>6.3x+0.65$ is satisfied.

4. A method of producing the magnetic compound according to claim 1, the method comprising:

a step of preparing molten alloy having a composition represented by $(R_{(1-x)}Zr_x)_a(Fe_{(1-y)}Co_y)_bT_cM_d$;

a step of quenching the molten alloy at a rate of $1\times10^2$ K/sec to $1\times10^7$ K/sec; and a step of crushing solidified alloy, which is obtained by the quenching, and then causing A to penetrate into the crushed alloy, wherein R represents one or more rare earth elements, T represents one or more elements selected from the group consisting of Ti, V, Mo, and W, M represents one or more elements selected from the group consisting of unavoidable impurity elements, Al, Cr, Cu, Ga, Ag, and Au, $0 \leq x \leq 0.5$, $0 \leq y \leq 0.6$, $4 \leq a \leq 20$, $b=100-a-c-d$, $0<c<7$, $0 \leq d \leq 1$, and A represents one or more elements selected from the group consisting of N, C, H, and P.

5. The method according to claim 4, further comprising:

a step of performing a heat treatment at 800° C. to 1300° C. for 2 hours to 120 hours after the quenching step.

6. A rare earth element-containing magnetic compound comprising a $ThMn_{12}$ type crystal structure, wherein a lattice constant a of the crystal structure is within a range of 0.850 nm to 0.875 nm, a lattice constant c of the crystal structure is within a range of 0.480 nm to 0.505 nm, a lattice volume of the crystal structure is within a range of 0.351 $nm^3$ to 0.387 $nm^3$, a hexagon A is defined as a six-membered ring centering on a rare earth atom, which is formed of Fe (8i) and Fe(8j) sites, a hexagon B is defined as a six-membered ring which includes Fe (8i) and Fe(8j) sites in which Fe (8i)-Fe (8i) dumbbells form two sides facing each other, a hexagon C is defined as a six-membered ring which is formed of Fe (8j) and Fe(8f) sites and whose center is positioned on a straight line connecting Fe (8i) and the rare earth atom to each other, a length of the hexagon A in a direction of axis a is shorter than 0.611 nm, an average distance between Fe (8i) and Fe (8i) in the hexagon A is 0.254 nm to 0.288 nm, an average distance between Fe (8j) and Fe (8j) in the hexagon B is 0.242 nm to 0.276 nm, and an average distance between Fe (8f) and Fe (8f) facing each other with the center of the hexagon C interposed therebetween in the hexagon C is 0.234 nm to 0.268 nm.

7. A magnetic powder which is made of a compound represented by $(R_{(1-x)}Zr_x)_a(Fe_{(1-y)}Co_y)_bT_cM_dA_e$, the magnetic powder comprising a $ThMn_{12}$ type crystal structure, wherein a volume percentage of an α-(Fe,Co) phase is 20% or lower, R represents one or more rare earth elements, T represents one or more elements selected from the group consisting of Ti, V, Mo, and W, M represents one or more elements selected from the group consisting of unavoidable impurity elements, Al, Cr, Cu, Ga, Ag, and Au, A represents one or more elements selected from the group consisting of N, C, H, and P, $0 \leq x \leq 0.5$, $0 \leq y \leq 0.7$, $4 \leq a \leq 20$, $b=100-a-c-d$, $0<c \leq 7$, $0 \leq d \leq 1$, and $1 \leq e \leq 18$.

* * * * *